United States Patent [19]

Legg

[11] 4,206,995

[45] Jun. 10, 1980

[54] REPRODUCTION MACHINE WITH ON BOARD DOCUMENT HANDLER DIAGNOSTICS

[75] Inventor: Ernest L. Legg, Fairport, N.Y.

[73] Assignee: Xerox Corporation, Stamford, Conn.

[21] Appl. No.: 829,019

[22] Filed: Aug. 30, 1977

[51] Int. Cl.[2] ..... G03G 21/00

[52] U.S. Cl. ..... 355/14 C; 271/261

[58] Field of Search ..... 355/14, 3 SH, 14 R, 355/14 C, 14 SH

[56] References Cited

U.S. PATENT DOCUMENTS

| | | | |
|---|---|---|---|
| 3,880,516 | 4/1975 | Post et al. | 355/14 |
| 4,023,901 | 5/1977 | Kulbida et al. | 355/14 |
| 4,025,186 | 5/1977 | Hunt et al. | 355/14 |
| 4,035,072 | 7/1977 | Deetz et al. | 355/14 |
| 4,062,061 | 12/1977 | Batchelor et al. | 355/14 X |
| 4,099,860 | 7/1978 | Connin | 355/14 |
| 4,170,414 | 10/1979 | Hubert et al. | 355/3 SH |

*Primary Examiner*—A. D. Pellinen

*Attorney, Agent, or Firm*—Ronald F. Chapuran

[57] ABSTRACT

An electrostatographic type copying or reproduction machine incorporating a programmable controller to operate the various machine components in an integrated manner to produce copies is disclosed herein. The controller carries a master program varying machine operating parameters from which an operating program for the specific copy run desired is formed and used to operate the machine components to produce the copies programmed. As an aide to maintain copy quality and machine reliability, the programmable controller includes diagnostic programs for operating the machine components in a particular manner. For example, the document handler can be thus conditioned to automatically move a document to a preselected location along the paper path to permit inspection for proper document alignment.

8 Claims, 28 Drawing Figures

FROM CLOCK 552
Ø1
Ø2
542
507
510
TO: MEMORY 545,546
ADDRESS
A0
A15
(HOLD A)
(HOLD)
(DBIN)
EN
TO: MEMORY
TO: MEMORY 545,546
508
511
DATA
D0
D7
TO: MEMORY READY 548
(MEMR)
(OUT)
(WO)
(INP)
(MI)
(HALTA)
(STACK)
(INTA)
LATCH REGISTER
FROM: 552 Ø1-1
(SYNC)
(READY)
FROM: MEMORY READY 548
(INT)
(RESET)
(WAIT)
FROM: 550
(INTE)
(WR)
TO: MEMORY 546,545

MEMORY READY

REPRODUCTION MACHINE WITH ON BOARD DOCUMENT HANDLER DIAGNOSTICS

BACKGROUND OF THE INVENTION

This invention relates to electrostatographic xerographic type reproduction machines, and more particularly, to an improved control system for such machines.

The advent of higher speed and more complex copiers and reproduction machines has brought with it a corresponding increase in the complexity in the machine control wiring and logic. While this complexity manifests itself in many ways, perhaps the most onerous involves the inflexibility of the typical control logic/-wiring systems. For as can be appreciated, simple unsophisticated machines with relatively simple control logic and wiring can be altered and modified easily to incorporate changes, retrofits, and the like. Servicing and repair of the control logic is also fairly simple. On the other hand, some modern high speed machines, which often include sorters, a document handler, choice of copy size, multiple paper trays, jam protection and the like have extremely complex logic systems making even the most minor changes and improvements in the control logic difficult, expensive and time consuming. And servicing or repairing the machine control logic may similarly entail substantial difficulty, time and expense.

To mitigate problems of the type alluded to, a programmable controller may be used, enabling changes and improvements in the machine operation to be made through the expediency of reprogramming the controller. However, the control data which operates the machine and which is stored in the controller memory pending use, must be transferred to the various machine components at the proper time and in the correct sequence without unduly interfering with or intruding unnecessarily upon the other essential functions and operations of the controller.

Unfortunately, as the complexity of these high speed reproduction machines increases, so does the potential for malfunctions. The present invention is especially concerned with mitigating downtime by incorporating built-in diagnostic programs in the controller which directs the operation of the machine components. The automatic document handler is an extremely intricate device which must be exactly synchronized with the machine processor. Accordingly, some of these diagnostic programs are directed towards checking the operation of the document handler.

OBJECTS AND SUMMARY OF THE INVENTION

Therefore, it is the primary object of this invention to provide built-in diagnostic capabilities for a reproduction machine under the control of a programmable controller.

It is a further object of this invention to provide a control for the machine document handler that automatically moves documents to selected inspection stations along the paper path.

These and other objects of this invention are accomplished by providing the machine controller with built-in diagnostic programs which can be accessed by a service personnel or, in some instances, by the user. Since some of the diagnostic programs are so complex, the controller is programmed to permit the user to access only a limited number of diagnostic programs. On the other hand, the service personnel has the capability to disclose progressively more complex diagnostic programs to the user as she becomes more familiar with the machine operations. In one of the diagnostic routines for the document handler, the documents are cycled through the document handler until they reach a preselected station, at which time the document handler is automatically stopped to permit visual inspection for document alignment.

BRIEF DESCRIPTION OF THE DRAWINGS

Other objects and advantages will be apparent from the ensuing description and drawings in which.

DETAILED DESCRIPTION OF THE PREFERRED EMBODIMENT OF THE INVENTION

Figure 1:
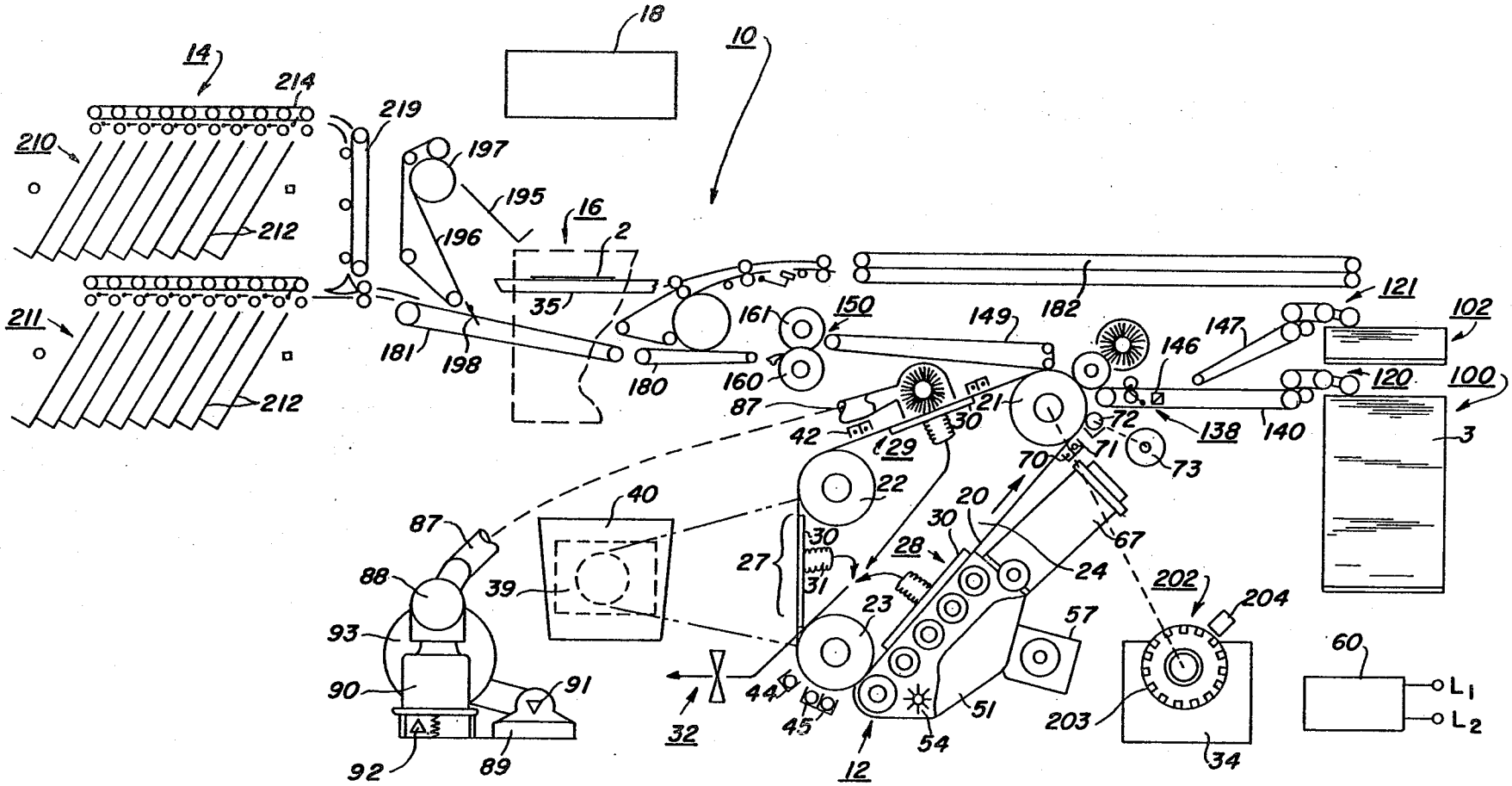
FIG. 1 is a schematic representation of an exemplary reproduction apparatus incorporating the control system of the present invention.
Figure 2:
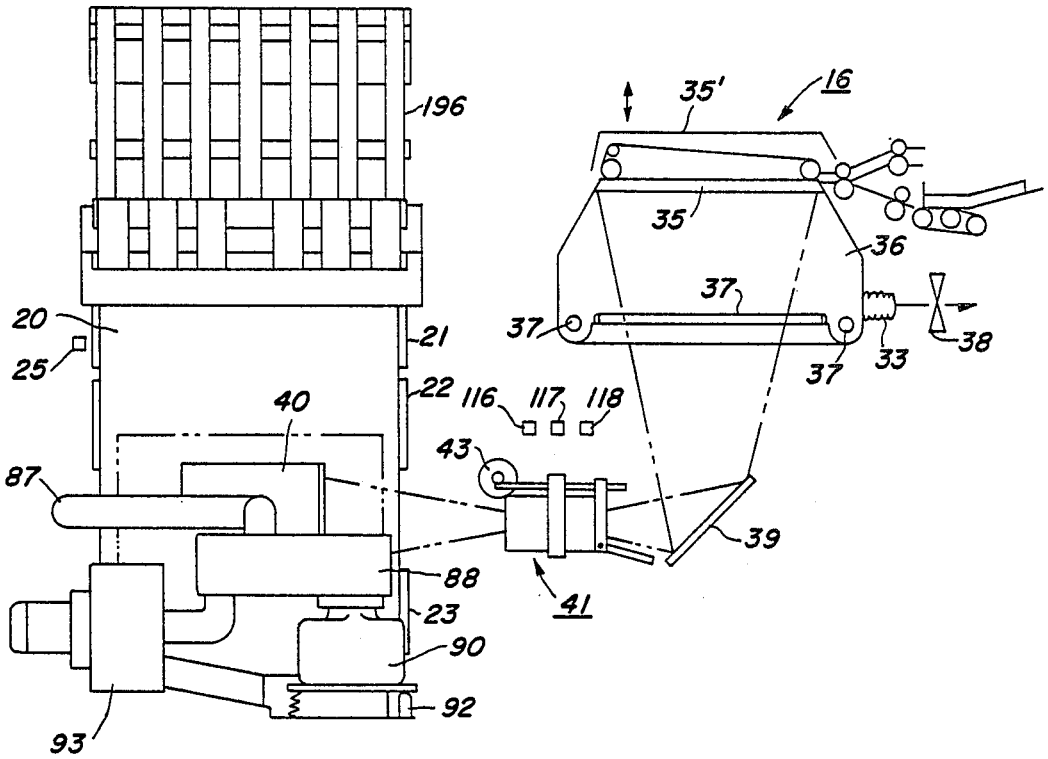
FIG. 2 is a vertical sectional view of the apparatus shown in FIG. 1 along the image plane.
Figure 3:
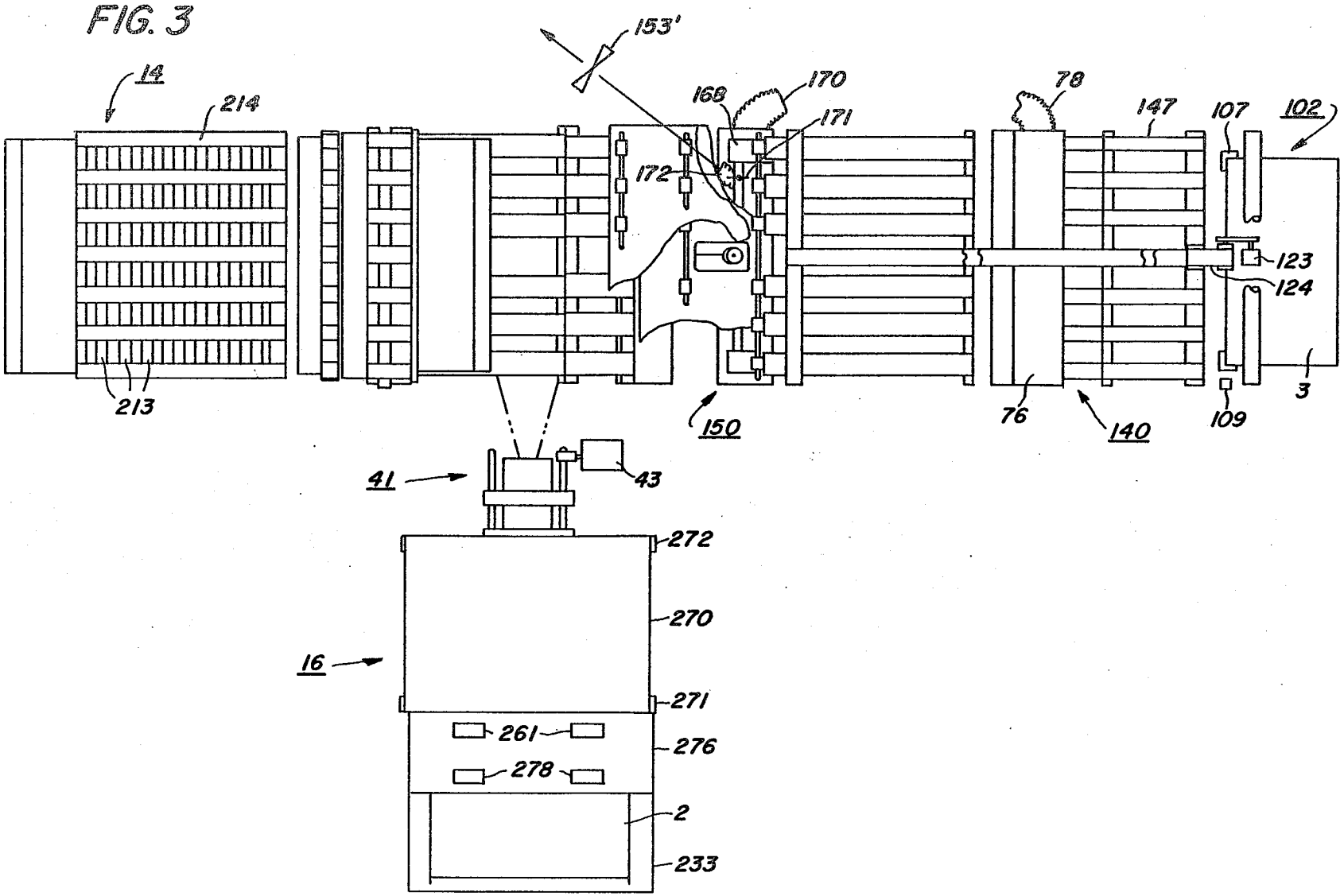
FIG. 3 is a top plane view of the apparatus shown in FIG. 1.

Referring particularly to FIGS. 1-3 of the drawings, there is shown, in schematic outline, an electrostatic reproduction system or host machine, identified by numeral 10, incorporating the control arrangement of the present invention. To facilitate description, the reproduction system 10 is divided into a main electrostatic xerographic processor 12, sorter 14, document handler 16, and controller 18. Other processor, sorter and/or document handler types and constructions, and different combinations thereof may instead by envisioned.

PROCESSOR

Processor 12 utilizes a photoreceptor in the form of an endless photoconductive belt 20 supported in generally triangular configuration by rolls 21, 22, 23. Belt supporting rolls 21, 22, 23 are in turn rotatably journaled on subframe 24.

In the exemplary processor illustrated, belt 20 comprises a photoconductive layer of selenium, which is the light receiving surface and imaging medium, on a conductive substrate. Other photoreceptor types and forms, such as comprising organic materials or of multilayers or a drum may instead be envisioned. Still other forms may comprise scroll type arrangements wherein webs of photoconductive material may be played in and out of the interior of supporting cylinders.

Suitable biasing means (not shown) are provided on subframe 24 to tension the photoreceptor belt 20 and insure movement of belt 20 along a prescribed operating path. Belt tracking switch 25 (shown in FIG. 2) monitors movement of belt 20 from side to side. Belt 20 is supported so as to provide a trio of substantially flat belt runs opposite exposure, developing, and cleaning stations 27, 28, 29 respectfully. To enhance belt flatness at these stations, vacuum platens 30 are provided under belt 20 at each belt run. Conduits 31 communicate vacuum platens 30 with a vacuum pump 32. Photoconductive belt 20 moves in the direction indicated by the solid line arrow, drive thereto being effected through roll 21, which in turn is driven by a main drive motor.

Processor 12 includes a generally rectangular, horizontal transparent platen 35 on which each original 2 to be copied is disposed. A two or four sided illumination assembly, consisting of internal reflectors 36 and flash lamps 37 (shown in FIG. 2) disposed below and along at least two sides of platen 35, is provided for illuminating the original 2 on platen 35. To control temperatures within the illumination space, the assembly is coupled through conduit 33 with a vacuum pump 38 which is adapted to withdraw overly heated air from the space. To retain the original 2 in place on platen 35 and prevent escape of extraneous light from the illumination assembly, a platen cover 35' may be provided.

The light image generated by the illumination system is projected via mirrors 39, 40 and a variable magnification lens assembly 41 onto the photoreceptive belt 20 at the exposure station 27. Reversible motor 43 is provided to move the main lens and add on lens elements that comprise the lens assembly 41 to different predetermined positions and combinations to provide the preselected image sizes corresponding to push button selectors 818, 819, 820 on operator module 800. (See FIG. 18). Sensors 116, 117, 118 signal the present disposition of lens assembly 41. Exposure of the previously charged belt 20 selectively discharges the photoconductive belt to produce on belt 20 an electrostatic latent image of the original 2. To prepare belt 20 for imaging, belt 20 is uniformly charged to a preselected level by charge corotron 42 upstream of the exposure station 27.

To prevent development of charged but unwanted image areas, erase lamps 44, 45 are provided. Lamp 44, which is referred to herein as the pitch fadeout lamp, is supported in transverse relationship to belt 20, lamp 44 extending across substantially the entire width of belt 20 to erase (i.e. discharge) areas of belt 20 before the first image, between successive images, and after the last image. Lamps 45, which are referred to herein as edge fadeout lamps, serve to erase areas bordering each side of the images.

DOCUMENT HANDLER

Figure 4:
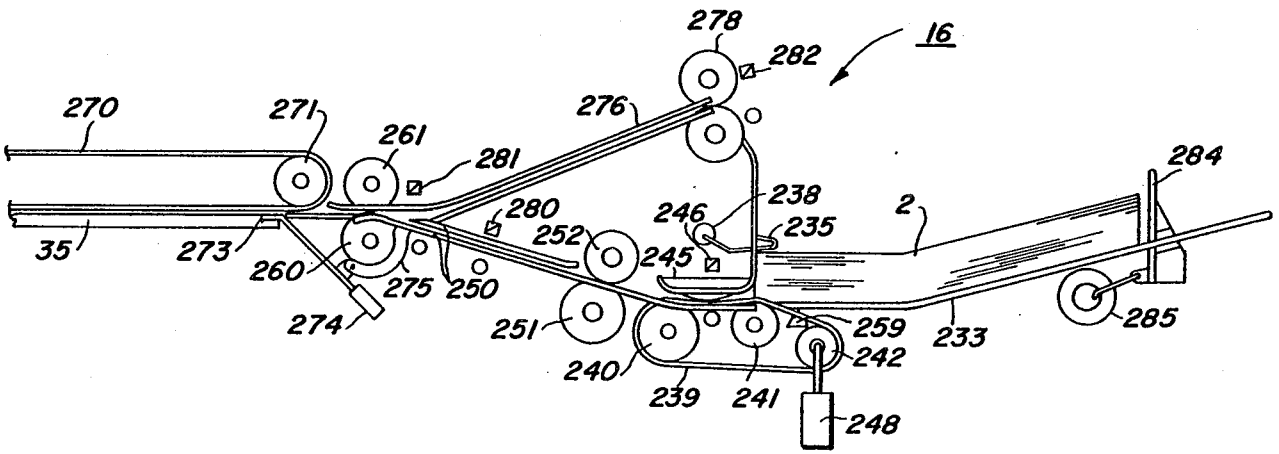
FIG. 4 is a schematic view showing details of the document handler for the apparatus shown in FIG. 1.
Figure 5:
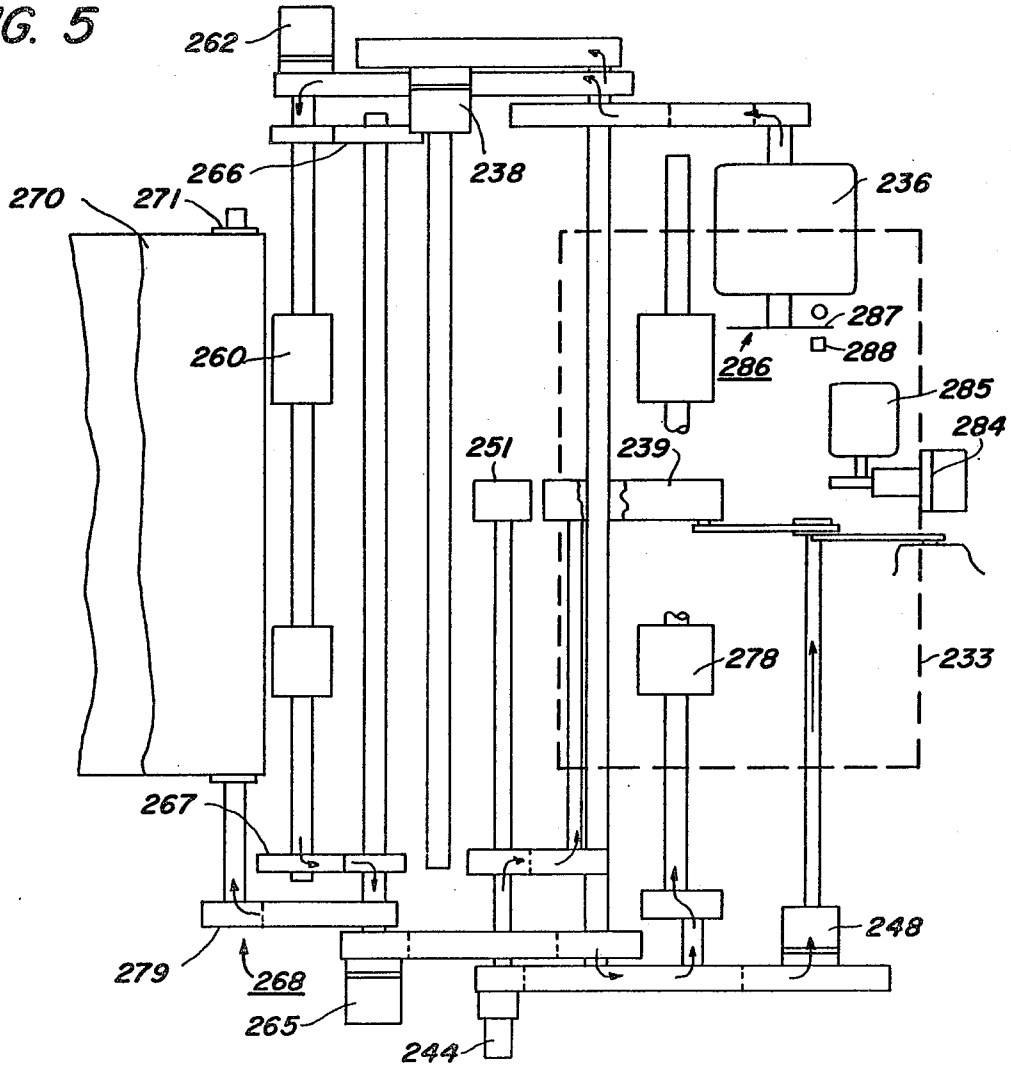
FIG. 5 is a view showing details of the drive mechanism for the document handler shown in FIG. 4.

Referring particularly to FIGS. 4 and 5, document handler 16 includes a tray 233 into which originals or documents 2 to be copied are placed by the operator following which a cover (not shown) is closed. A movable bail or separator 235, driven in an oscillatory path from motor 236 through a solenoid operated one revolution clutch 238, is provided to maintain document separation.

A document feed belt 239 is supported on drive and idler rolls 240, 241 and kicker roll 242 under tray 233, tray 233 being suitably apertured to permit the belt surface to project therewithin. Feedbelt 239 is driven by motor 236 through electromagnetic clutch 244. Guide 245, disposed near the discharge end of feed belt 239, cooperates with belt 239 to form a nip between which the documents pass.

A photoelectric type sensor 246 is disposed adjacent the discharge end of belt 239. Sensor 246 responds on failure of a document to feed within a predetermined interval to actuate solenoid operated clutch 248 which raises kicker roll 242 and increases the surface area of feed belt 239 in contact with the documents. Another sensor 259 located underneath tray 233 provides an output signal when the last document 2 of each set has left the tray 233.

Document guides 250 route the document fed from tray 233 via roll pair 251, 252 to platen 35. Roll 251 is drivingly coupled to motor 236 through electromagnetic clutch 244. Contact of roll 251 with roll 252 turns roll 252.

Roll pair 260, 261 at the entrance to platen 35 advance the document onto platen 35, roll 260 being driven through electromagnetic clutch 262 in the forward direction. Contact of roll 260 with roll 261 turns roll 261 in the document feeding direction. Roll 260 is selectively coupled through gearset 268 with motor 236 through electromagnetic clutch 265 so that on engagement of clutch 265 and disengagement of clutch 262, roll 260 and roll 261 therewith turn in the reverse direction to carry the document back to tray 233 via return chute 276. One way clutches 266, 267 permit free wheeling of the roll drive shafts.

The document leaving roll pair 260, 261 is carried by platen feed belt 270 onto platen 35, belt 270 being comprised of a suitable flexible material having an exterior surface of xerographic white. Belt 270 is carried about drive and idler rolls 271, 272. Roll 271 is drivingly coupled to motor 236 for rotation in either a forward or reverse direction through clutches 262, 265. Engagement of clutch 262 operates through belt and pulley drive 279 to drive belt in the forward direction, engagement of clutch 265 operates through drive 279 to drive belt 270 in the reverse direction.

To locate the document in predetermined position on platen 35, a register 273 is provided at the platen inlet for engagement with the document trailing edge. For this purpose, control of platen belt 270 is such that following transporting of the document onto plate 35 and beyond register 273, belt 270 is reversed to carry the document backwards against register 273.

To remove the document from platen 35 following copying, register 273 is retracted to an inoperative position. Solenoid 274 is provided for moving register 273.

A document deflector 275, is provided to route the document leaving platen 35 into return chute 276. For this purpose, platen belt 270 and pinch roll pair 260, 261 are reversed through engagement of clutch 265. Discharge roll pair 278, driven by motor 236, carry the returning document into tray 233.

To monitor movement of the documents in document handler 16 and detect jams and other malfunctions, photoelectric type sensors 246 and 280, 281 and 282 are disposed along the document routes.

To align documents 2 returned to tray 233, a document patter 284 is provided adjacent one end of tray 233. Patter 284 is oscillated by motor 285.

TIMING

To provide the requisite operational synchronization between host machine 10 and controller 18 as will appear, processor or machine clock 202 is provided. Referring particularly to FIG. 1, clock 202 comprises a toothed disc 203 drivingly supported on the output shaft of main drive motor. A photoelectric type signal generator 204 is disposed astride the path followed by the toothed rim of disc 203, generator 204 producing, whenever drive motor 34 is energized, a pulse like signal output at a frequency correlated with the speed of motor 34, and the machine components driven therefrom.

As described, a second machine clock, termed a pitch reset clock 138 herein, and comprising timing switch 146 is provided. Switch 146 cooperates with sheet register fingers 141 to generate an output pulse once each revolution of fingers 141. As will appear, the pulse like output of the pitch reset clock is used to reset or resynchronize controller 18 with host machine 10.

Figure 7:
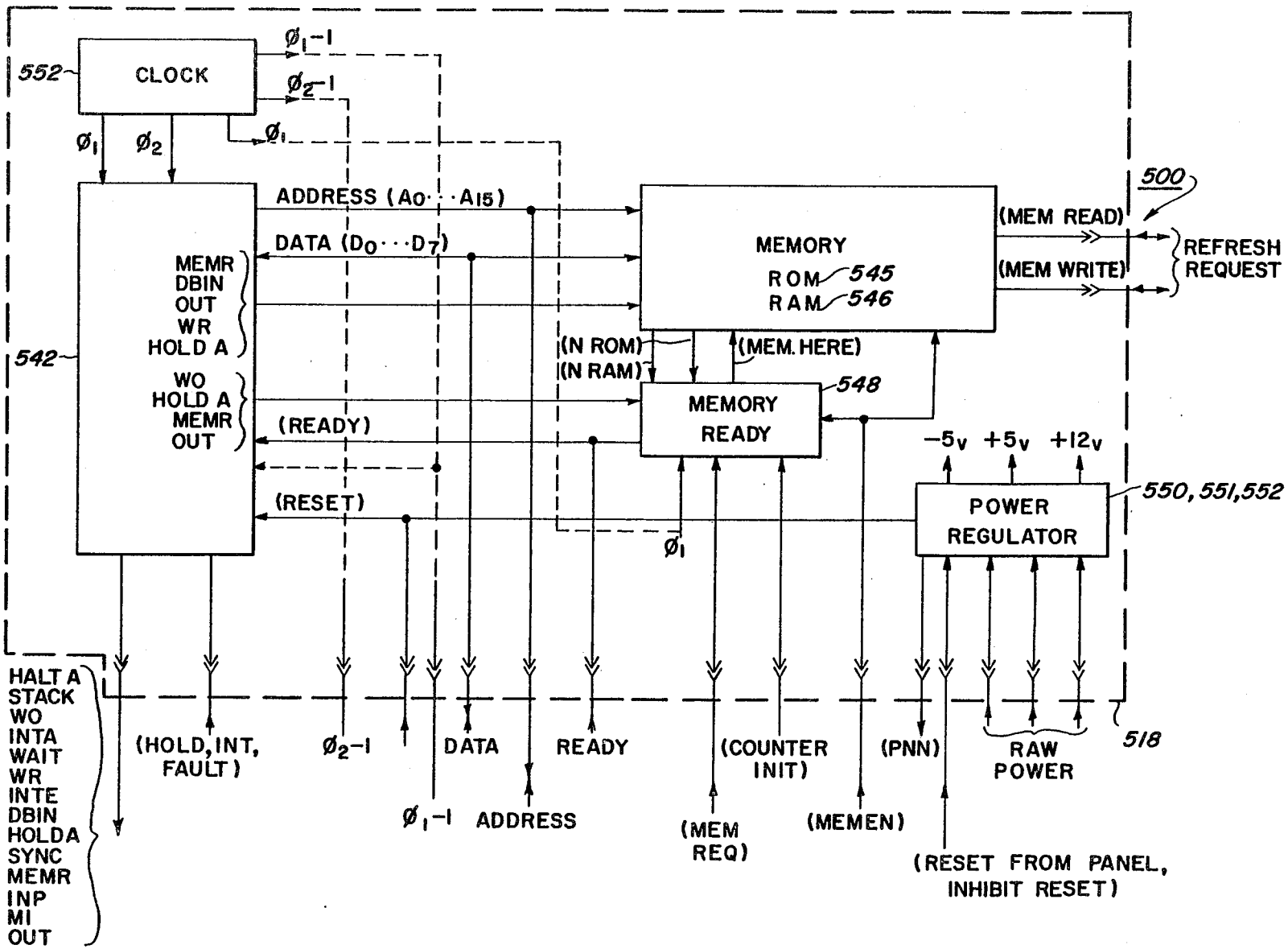
FIG. 7 is a block diagram of the controller CPU.

Referring to FIG. 5, a document handler clock 286 consisting of apertured disc 287 on the output shaft of document handler drive motor 236 and cooperating photoelectric type signal generator 288 is provided. As in the case of machine clock 202, document handler clock 286 produces an output pulse train from which components of the document handler may be synchronized. A real time clock such as clock 552 of FIG. 7, is utilized to control internal operations of the controller 18 as is known in the art.

CONTROLLER

Figure 6:
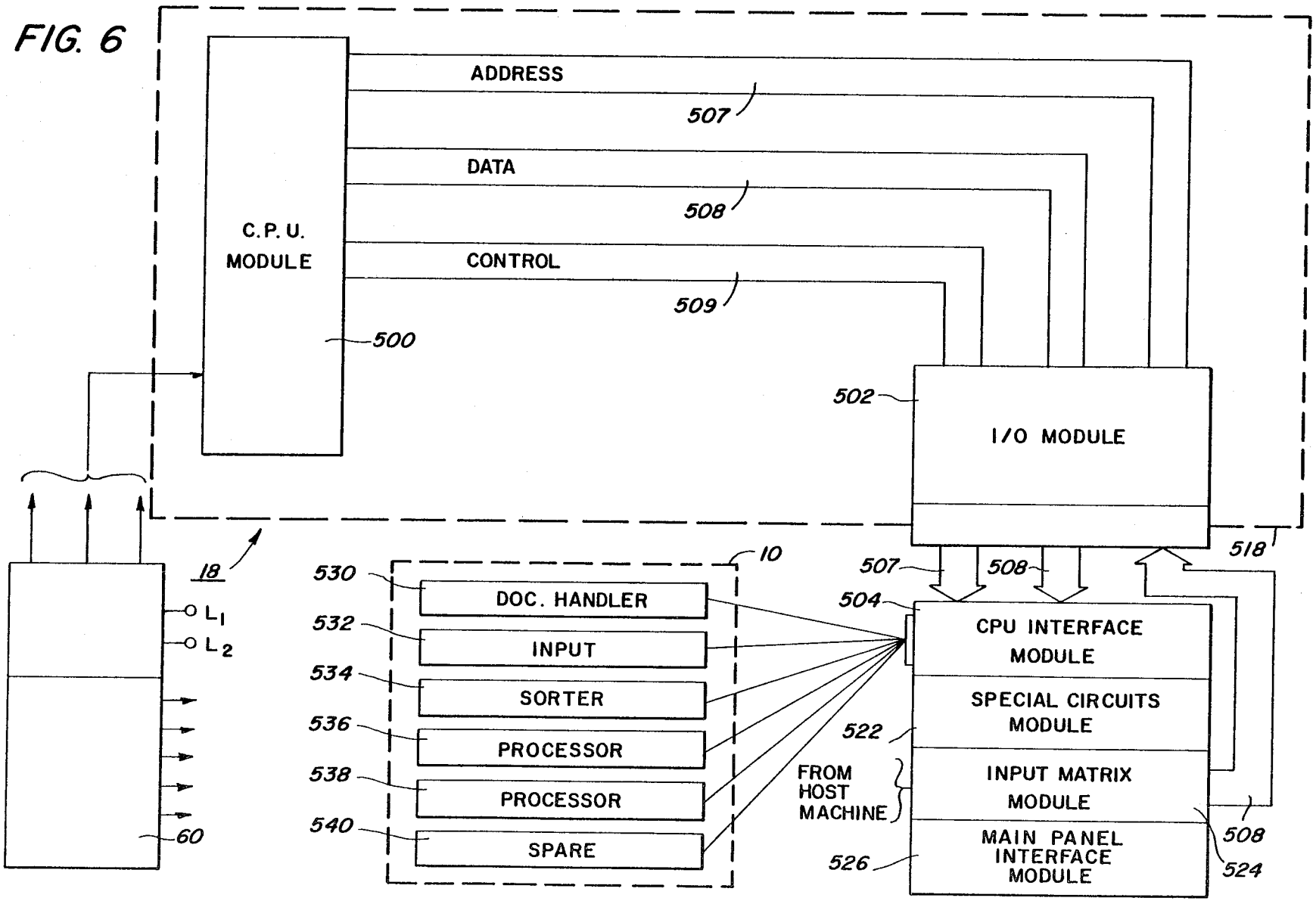
FIG. 6 is a block diagram of the controller for the apparatus shown in FIG. 1.

Referring to FIG. 6, controller 18 includes a Central Processor Unit (CPU) Module 500, Input/Output (I/O) Module 502, and Interface 504. Address, Data and Control Buses 507, 508, 509 respectively operatively couple CPU Module 500 and I/O Module 502. CPU Module 500 I/O Module 502 are disposed within a shield 518 to prevent noise interference.

Interface 504 couples I/O Module 502 with special circuits module 522, input matrix module 524, and main panel interface module 526. Module 504 also couples I/O Module 502 to operating sections of the machine, namely, document handler section 530, input section 532, sorter section 534 and processor sections 536, 538. A spare section 540, which may be used for monitoring operation of the host machine, or which may be later utilized to control other devices, is provided.

Figure 8:
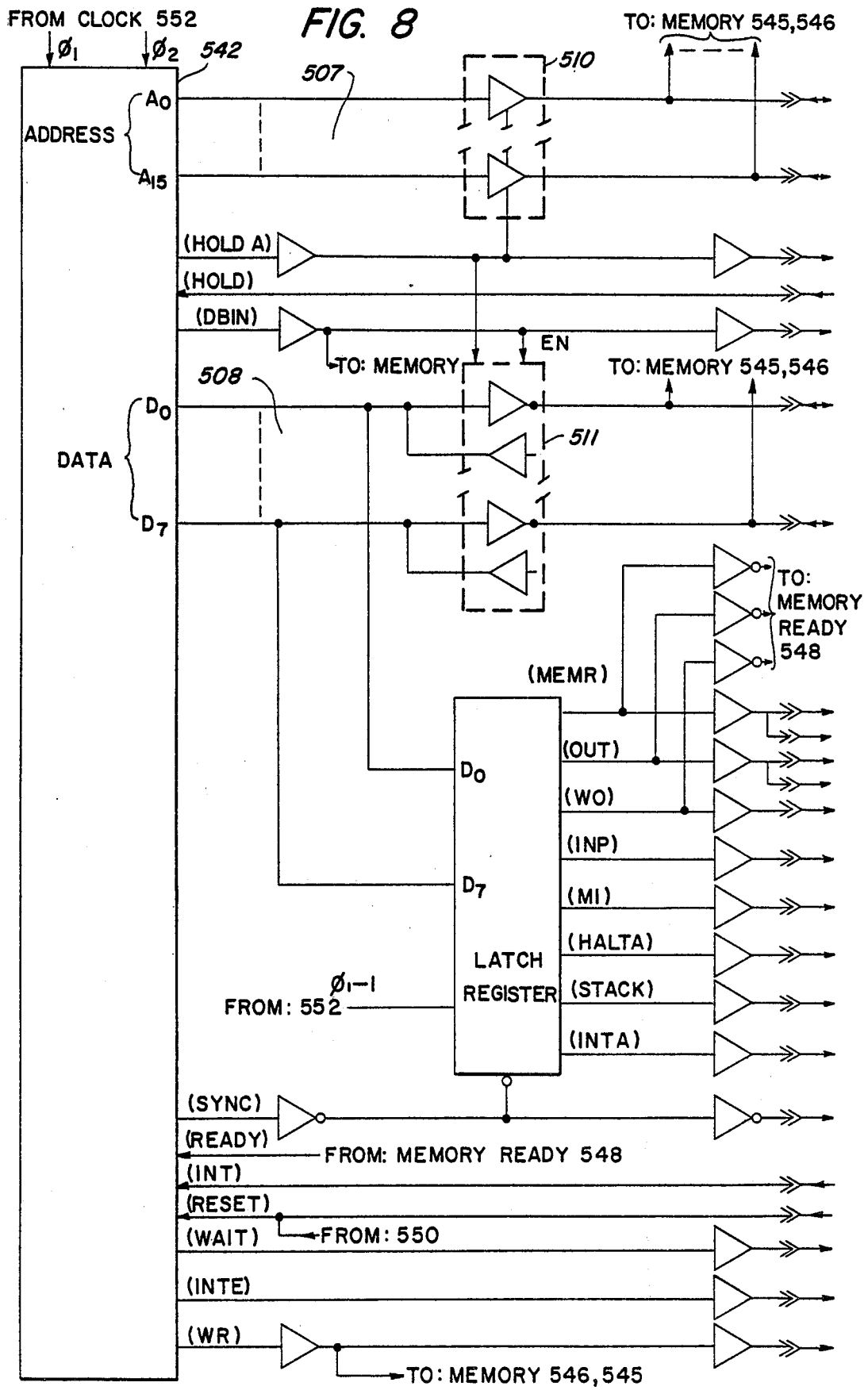
FIG. 8 is a block diagram showing the CPU microprocessor input/output connections.

Referring to FIGS. 7, 8, CPU module 500 comprises a processor 542 such as an Intel 8080 microprocessor manufactured by Intel Corporation, Santa Clara, Calif., 16 K Read Only Memory (herein ROM) and 2 K Random Access Memory (herein RAM) sections 545, 546, Memory Ready section 548, power regulator section 550, and onboard clock 552. Bipolar tri-state buffers 510, 511 in Address and Data buses 507, 508 disable the bus on a Direct Memory access (DMA) signal (HOLDA) as will appear. While the capacity of memory sections 545, 546 are indicated throughout as being 16 K and 2 K respectively, other memory sizes may be readily contemplated.

Figure 9:
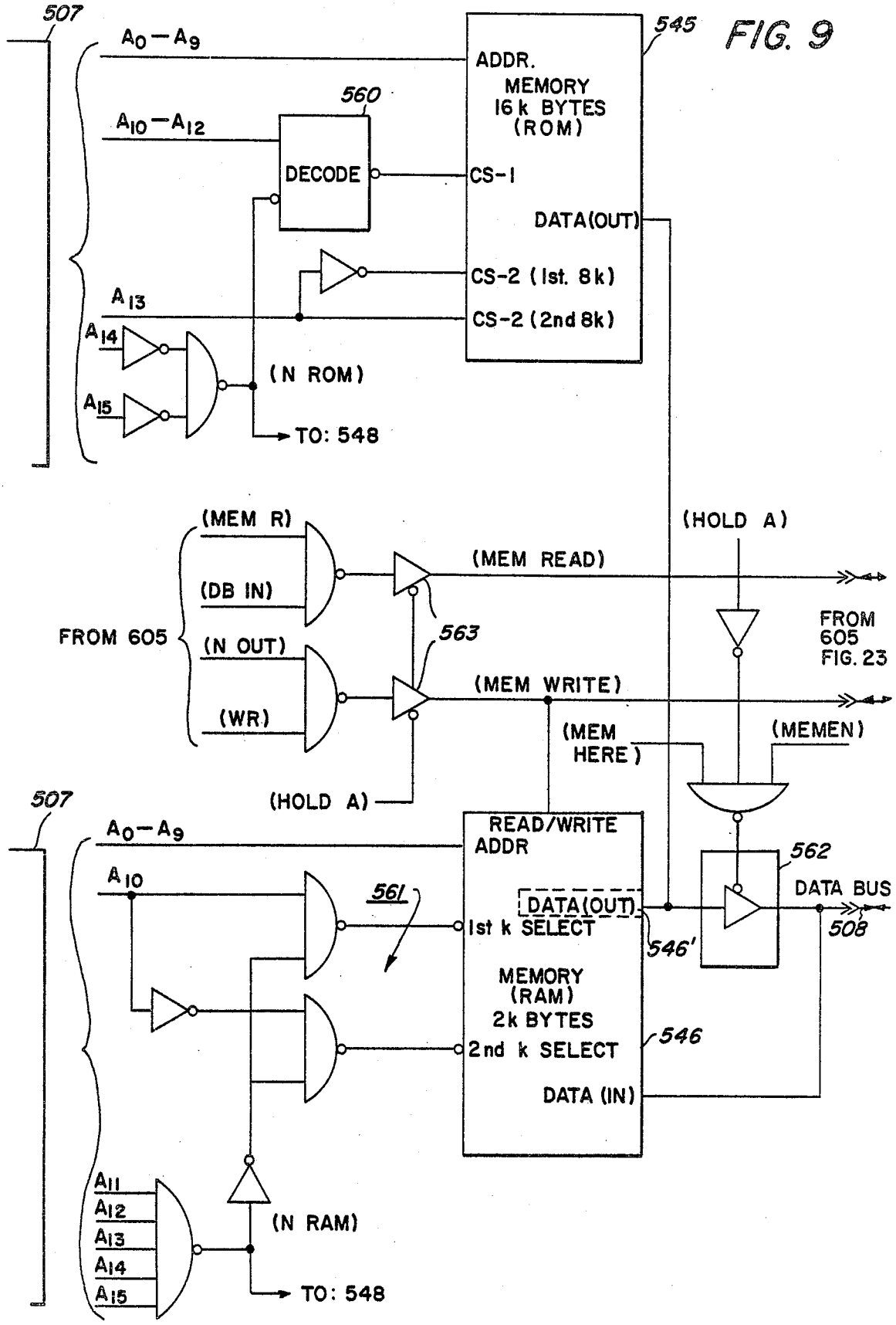
FIG. 9 is a logic schematic of the CPU memory.

Referring to FIG. 9, the memory bytes in ROM section 545 are implemented by address signals (Ao–A 15) from processor 542, selection being effected by 3 to 8 decode chip 560 controlling chip select 1 (CS-1) and a 1 bit selection (A 13) controlling chip select 2 (CS-2). The most significant address bits (A 14, A 15) select the first 16 K of the total 64 bytes of the addressing space. The memory bytes in RAM section 546 are implemented by Address signals (Ao–A 15) through selector circuit 561. Address bit A 10 serves to select the memory bank while the remaining five most significant bits (A 11–A 15) select the last 2 K bytes out of the 64 K bytes of addressing space. RAM memory section 546 includes a 40 bit output buffer the output of which is tied together with the output from ROM memory section 545 and goes to tri-state buffer 562 to drive Data bus 508. Buffer 562 is enabled when either memory section 545 or 546 is being addressed and either a (MEM READ) or DMA (HOLD A) memory request exists. An enabling signal (MEMEN) is provided from the machine control or service panel (not shown) which is used to permit disabling of buffer 562 during servicing of CPU Module 500. Write control comes from either processor 542 (MEM WRITE) or from DMA (HOLD A) control. Tri-state buffers 563 permit Refresh Control 605 of I/O Module 502 to access MEM READ and MEM WRITE control channels directly on a DMA signal (HOLD A) from processor 542 as will appear.

Figure 10:
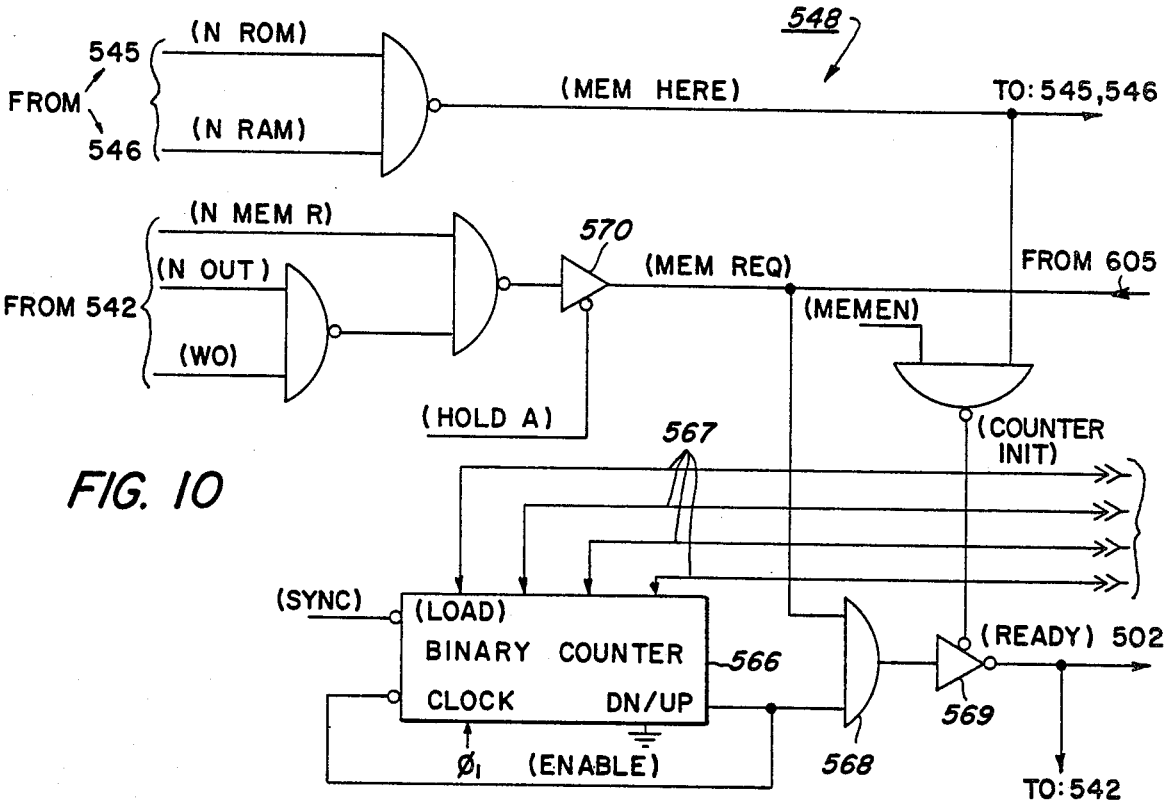
FIG. 10 is a logic schematic of the CPU memory ready.

Referring to FIG. 10, memory ready section 548 provides a READY signal to processor 542. A binary counter 566, which is initialized by a SYNC signal ($\phi$), to a prewired count as determined by input circuitry 567, counts up at a predetermined rate. At the maximum count, the output at gate 568 comes true stopping the counter 566. If the cycle is a memory request (MEM REQ) and the memory location is on board as determined by the signal (MEM HERE) to tri-state buffer 569, a READY signal is sent to processor 542. Tri-state buffer 570 in MEM REQ line permits Refresh Control 605 of I/O Module 502 to access the MEM REQ channel directly on a DMA signal (HOLD A) from processor 542 as will appear.

Figure 11A:
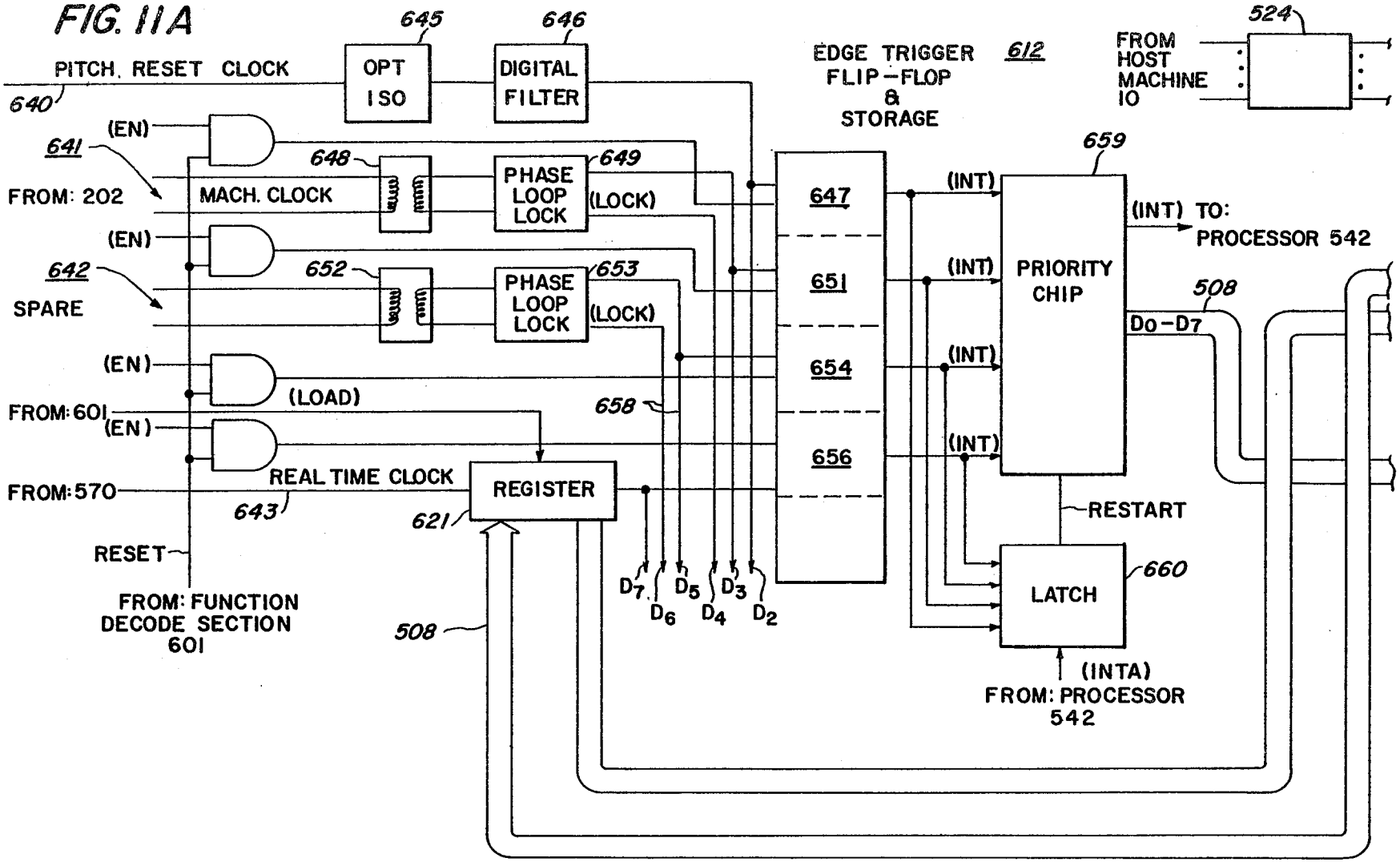
FIGS. 11*a* and 11*b* comprise a block diagram of the controller I/O module.

Referring to FIGS. 8,9,10, and the DMA timing chart (FIG. 8) data transfer from RAM section 546 to host machine 10 is effected through Direct Memory Access (DMA), as will appear. To initiate DMA, a signal (HOLD) is generated by Refresh Control 605 (FIG. 11*a*). On acceptance, processor 542 generates a signal HOLD ACKNOWLEDGE (HOLD A) which works through tri-state buffers 510, 511 and through buffers 563 and 570 to release Address bus 507, Data bus 508 and MEM READ, MEM WRITE, and MEM REQ channels (FIGS. 9, 10) to Refresh Control 605 of I/O Module 502.

Figure 11B:
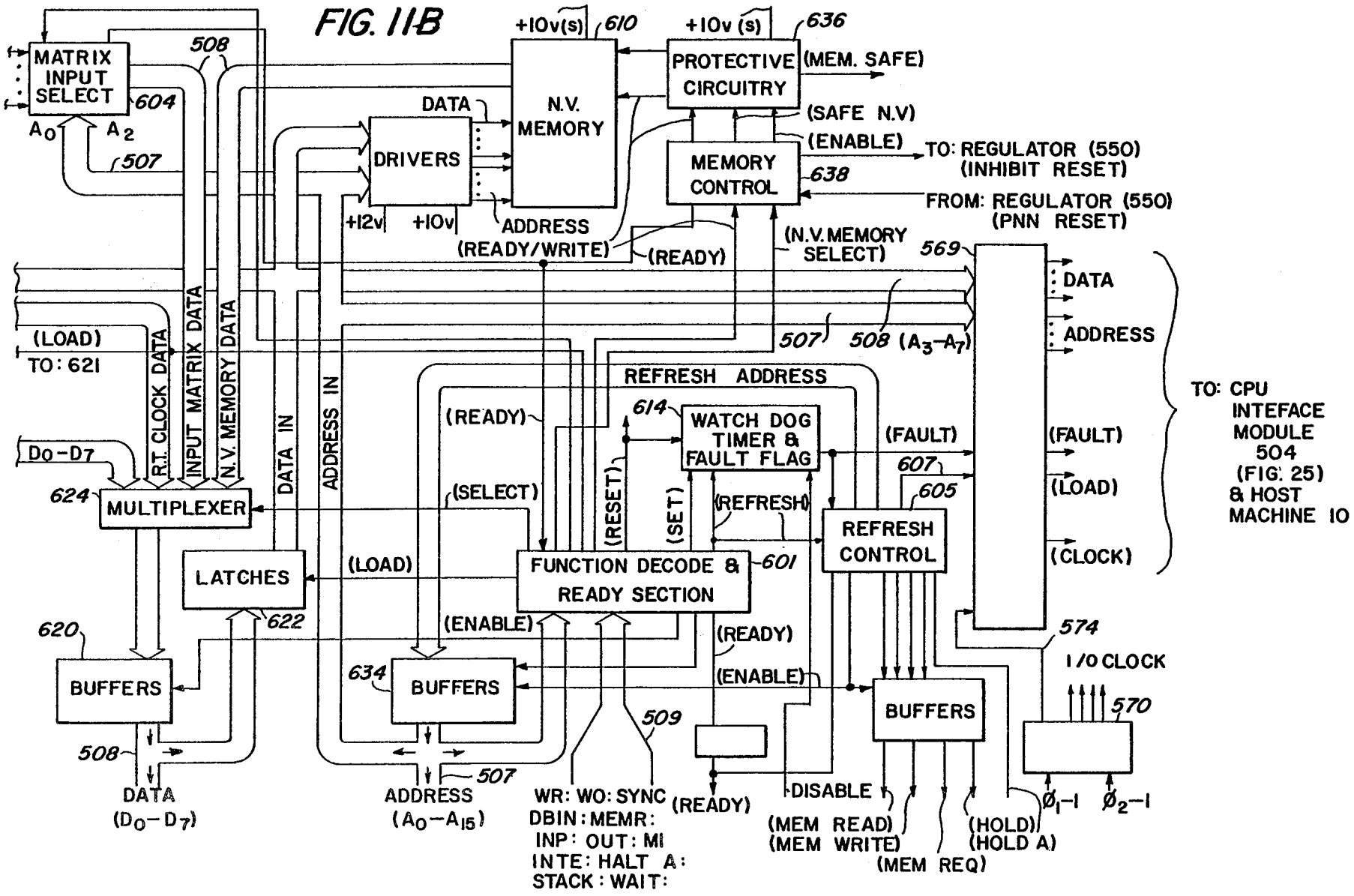

Referring to FIGS. 11*a* and 11*b*, I/O Module 502 interfaces with CPU module 500 through bi-directional Address, Data and Control buses 507, 508, 509. I/O Module 502 appears to CPU module 500 as a memory portion. Data transfers between CPU and I/O modules 500, 502, and commands to I/O module 502 except for output refresh are controlled by memory reference instructions executed by CPU module 500. Output refresh which is initiated by one of several uniquely decoded memory reference commands, enables Direct Memory access (DMA) by I/O module 502 to RAM section 546.

I/O module 502 includes Matrix Input select 604 (through which inputs from the host machine 10, are received), Refresh Control 605, Nonvolatile (NV) memory 610, Interrupt Control 612, Watch dog Timer and failure Flag 614 and clock 570.

A Function Decode Section 601 receives and interprets commands from CPU section 500 by decoding information on address bus 507 along with control signals from processor 542 on control bus 509. On command, decode section 601 generates control signals to perform the function indicated. These functions include (a) controlling tri-state buffers 620 to establish the direction of data flow in Data bus 508; (b) strobing data from Data bus 508 into buffer latches 622; (c) controlling multiplexer 624 to put data from Interrupt Control 612, Real Time clock register 621, Matrix Input Select 604 or N.V. memory 610 onto data bus 508; (d) actuating refresh control 605 to initiate a DMA operation; (e) actuating buffers 634 to enable address bits A0–A7 to be sent to the host machine 10 for input matrix read operations; (f) commanding operation of Matrix Input Select 604; (g) initiating read or write operation of N.V. memory 610 through Memory Control 638; (h) loading Real Time clock register 621 from data bus 508; and (i) resetting the Watch Dog timer or setting the Fault Failure flag 614. In addition, section 601 includes logic to control and synchronize the READY control line to CPU module 500, the READY line being used to advise module 500 when data placed on the Data bus by I/O module 502 is valid.

Watch dog timer and failure flag 614, which serves to detect certain hardwired and software malfunctions, comprises a free running counter which under normal circumstances is periodically reset by an output refresh command (REFRESH) from Function Decode Section 601. If an output refresh command is not received within a preset time interval, (i.e. 25 msec) a fault flip flop is set and a signal (FAULT) sent to the host machine 10. The signal (FAULT) also raises the HOLD line to disable CPU Module 500. Clearing of the fault flip flop may be by cycling power or generating a signal (RESET). A selector (not shown) may be provided to disable (DISABLE) the watch dog timer when desired. The fault flip flop may also be set by a command from the CPU Module to indicate that the operating program detected a fault.

Matrix Input select 604 has capacity to read up to 32 groups of 8 discrete inputs from host machine 10. Lines $A_3$ through $A_7$ of Address bus 507 are routed to host machine 10 via CPU Interface Module 504 to select the desired group of 8 inputs. The selected inputs from machine 10 are received via Input Matrix Module 524 (FIG. 15) and are placed by matrix 604 onto data bus 508 and sent to CPU Module 500 via multiplexer 624. Bit selection is effected by lines $A_0$ through $A_2$ of Address bus 507.

Output refresh control 605, when initiated, transfers either 16 or 32 sequential words from RAM memory output buffer 546' to host machine 10 at the predetermined clock rate in line 574. Direct Memory access (DMA) is used to facilitate transfer of the data at a relatively high rate. On a Refresh signal from Function Decode Section 601, Refresh Control 605 generates a HOLD signal to processor 542. On acknowledgement (HOLD A) processor 542 enters a hold condition. In this mode, CPU Module 500 releases address and data buses 507, 508 to the high impedance state giving I/O module 502 control thereover. I/O module 502 then sequentially accesses the 32 memory words from output buffer 546' (REFRESH ADDRESS) and transfers the contents to the host machine 10. CPU Module 500 is dormant during this period.

A control signal (LOAD) in line 607 along with the predetermined clock rate determined by the clock signal (CLOCK) in line 574 is utilized to generate eight 32 bit serial words which are transmitted serially via CPU Interface Module 504 to the host machine remote locations where serial to parallel transformation is performed. Alternatively, the data may be stored in addressable latches and distributed in parallel directly to the required destinations.

Figure 24:
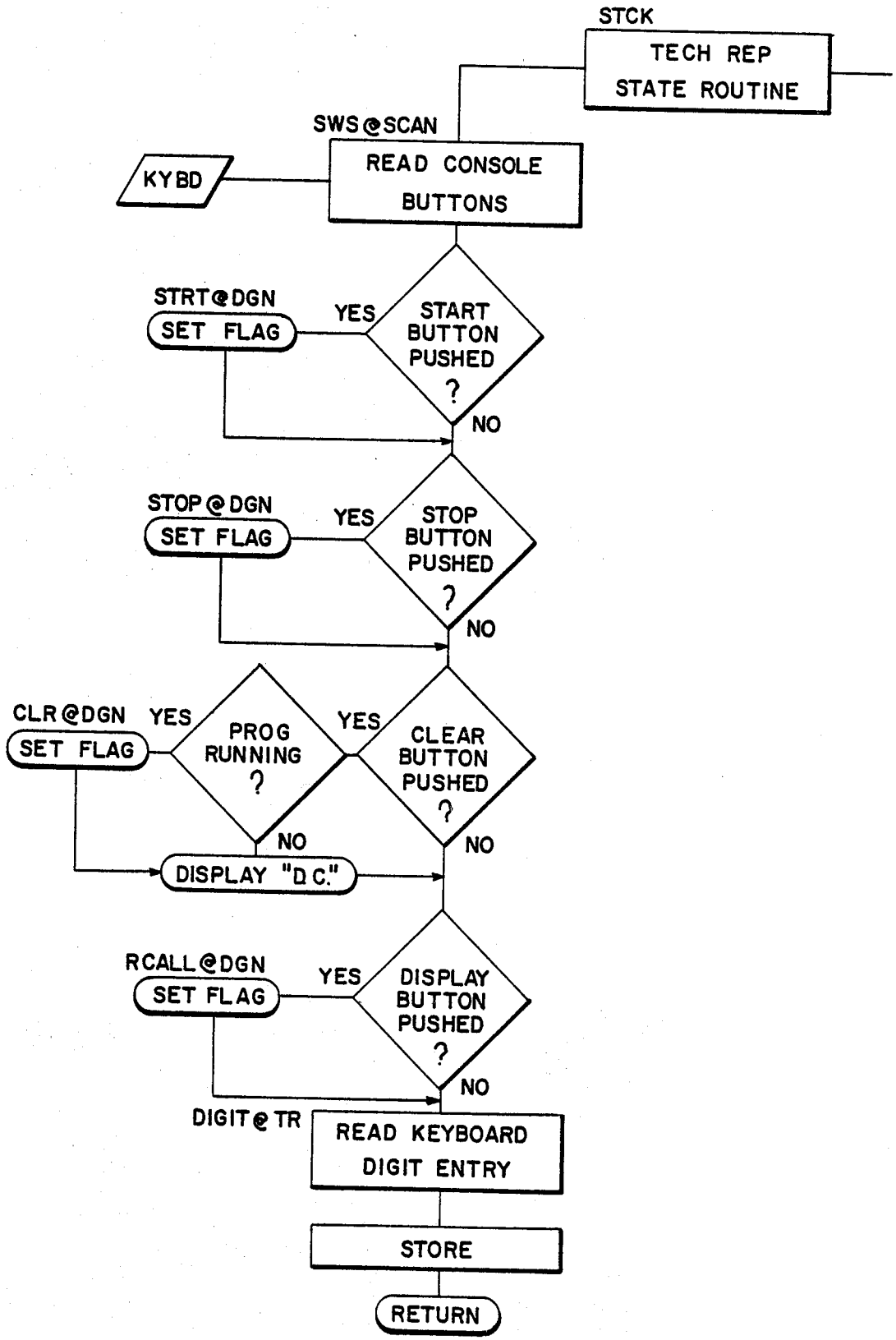
FIGS. 24 and 25 are flow charts which illustrate the operation of a diagnostic program for continuously cycling documents through the document handler and, if desired, displaying successive document travel times between various stations therein.

N.V. memory 610 comprises a predetermined number of bits of non-volatile memory stored in I/O module 502 under Memory Control 638. N.V. memory 610 appears to CPU module 500 as part of the CPU module memory complement and therefore may be accessed by the standard CPU memory reference instruction set. Referring particularly to FIG. 24, to sustain the contents of N.V. memory 610 should system power be interrupted, one or more rechargeable batteries 635 are provided exterior to I/O module 502. CMOS protective circuitry 636 couples batteries 635 to memory 610 to preserve memory 610 on a failure of the system power. A logic signal (INHIBIT RESET) prevents the CPU Module 500 from being reset during the N.V. memory write cycle interval so that any write operation in progress will be completed before the system is shut down.

For tasks that require frequent servicing, high speed response to external events, or synchronization with the operation of host machine 10, a multiple interrupt system is provided. These comprise machine based interrupts, herein referred to as Pitch Reset interrupt and the Machine interrupt, as well as a third clock driven interrupt, the Real Time interrupt.

Figure 12:
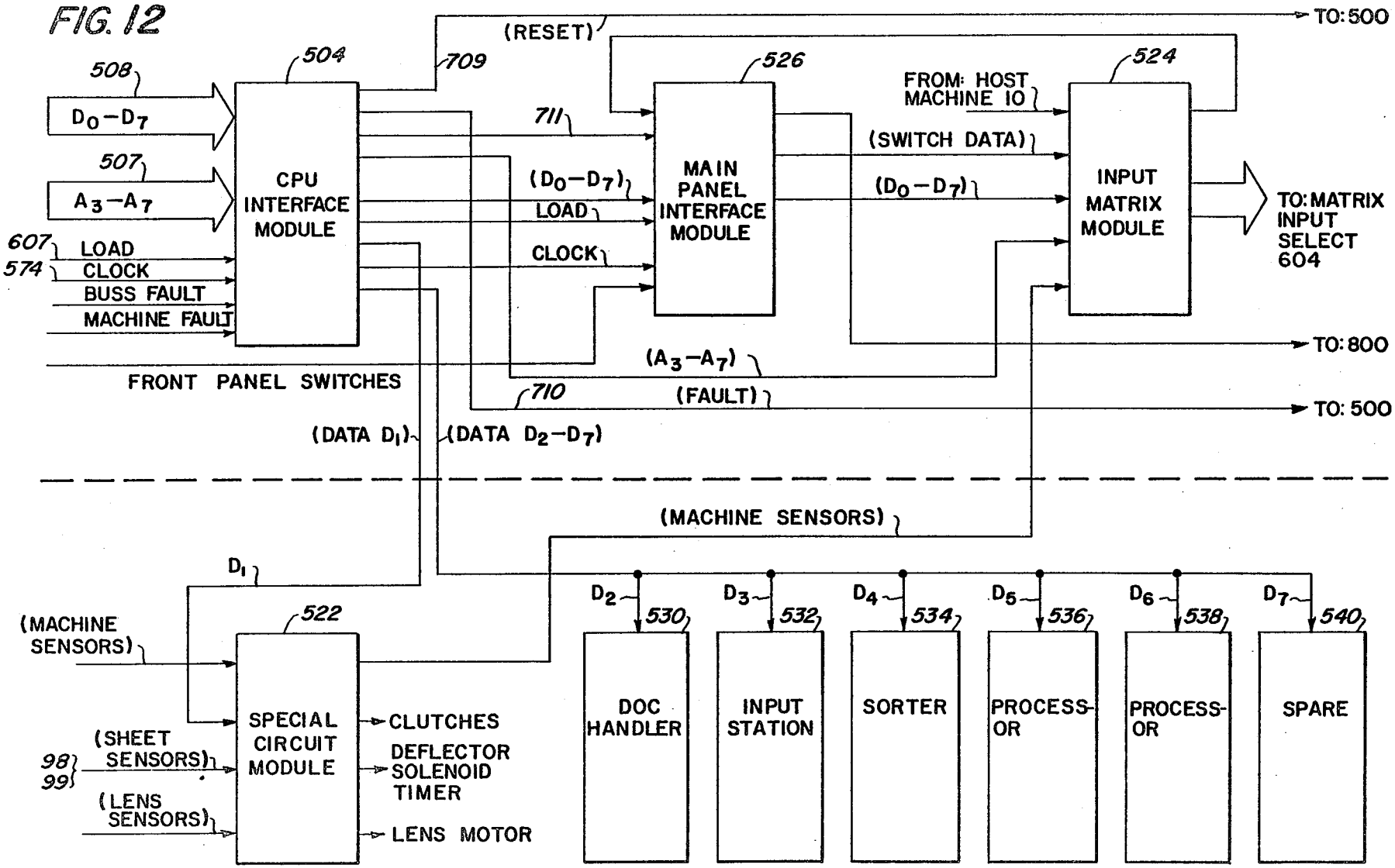
FIG. 12 is a block diagram of the apparatus interface and remote output connections.
Figure 13:
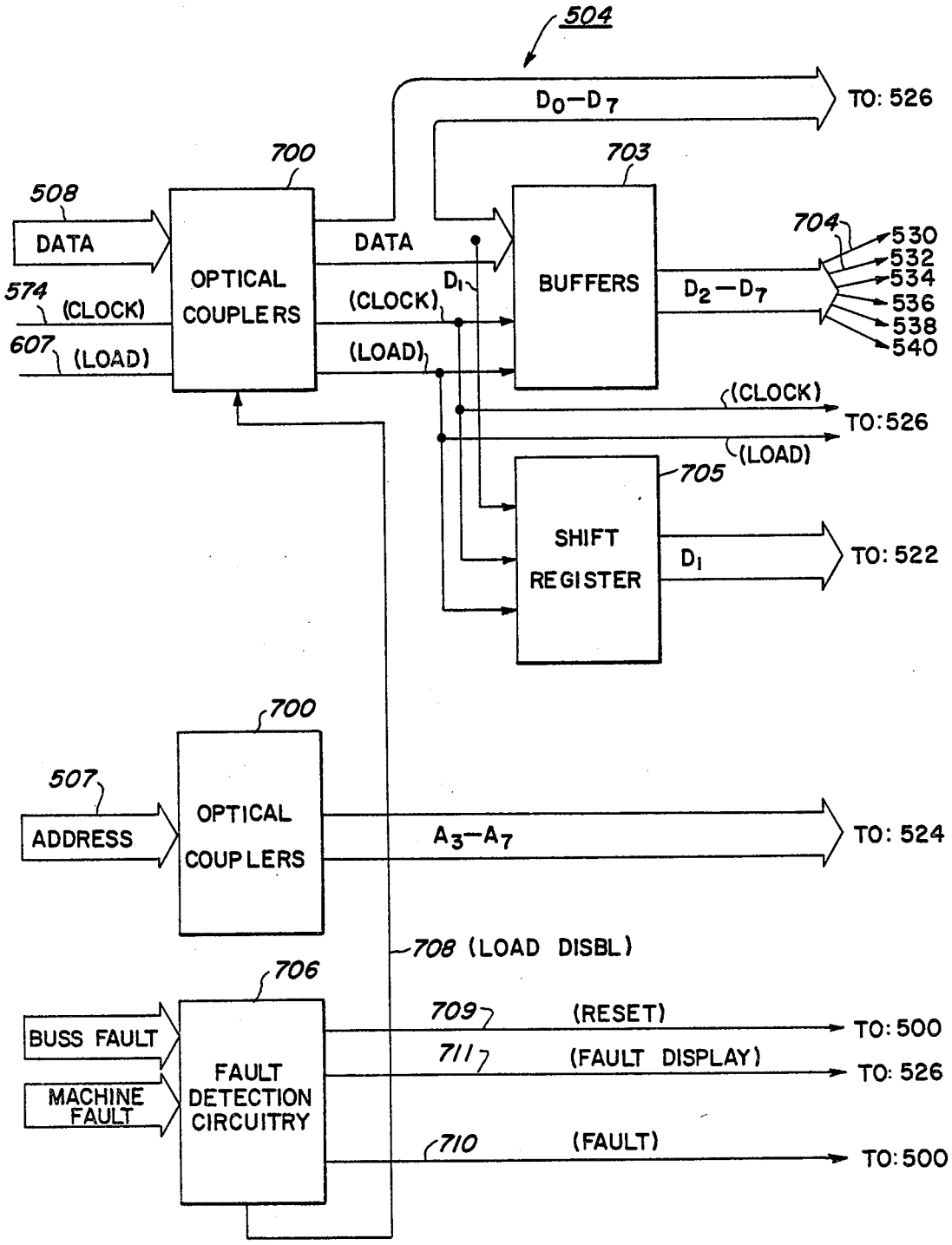
FIG. 13 is a block diagram of the CPU interface module.
Figure 14:
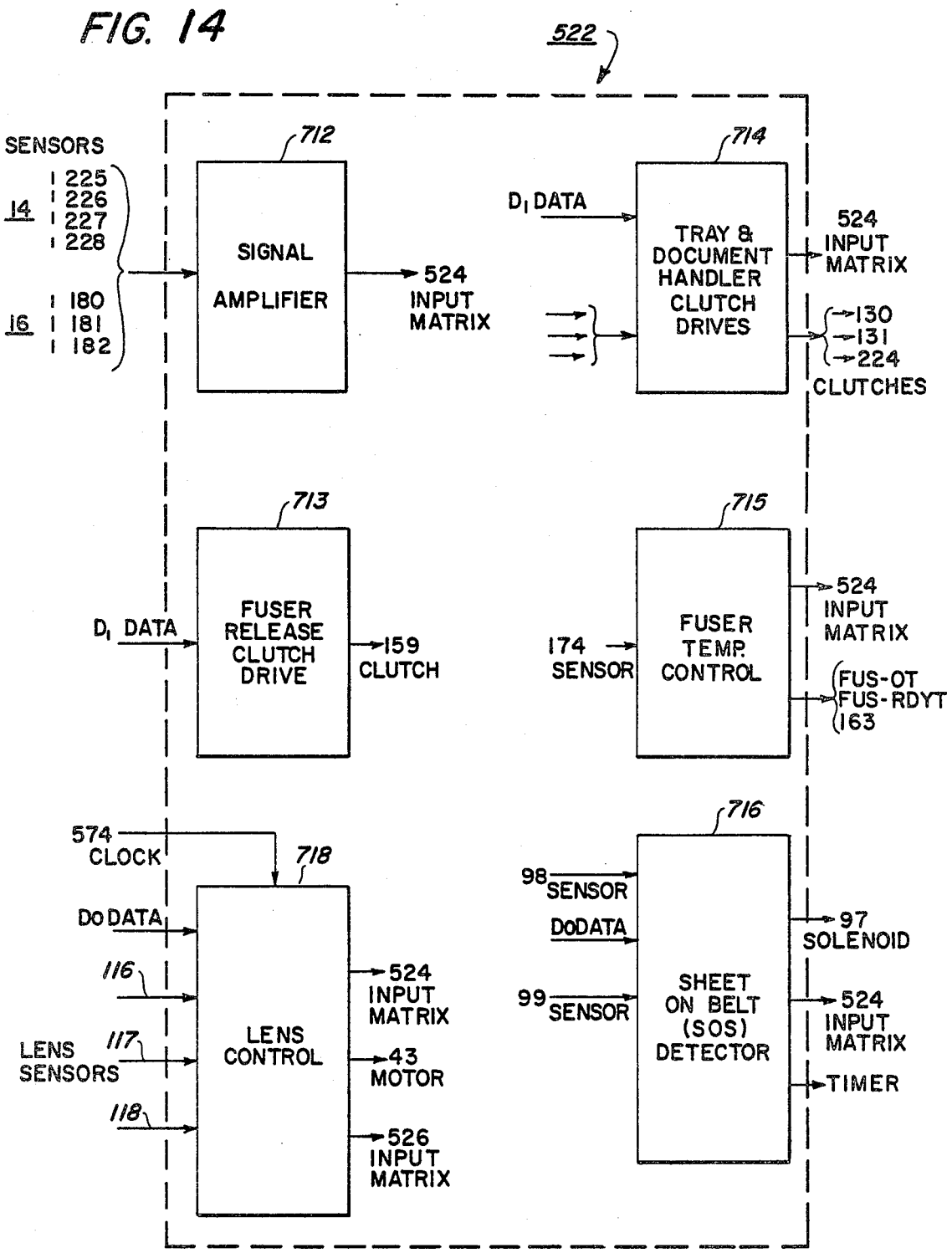
FIG. 14 is a block diagram of the apparatus special circuits module.

Referring particularly to FIGS. 12 and 14, special circuits module 522 comprises a collection of relatively independent circuits for either monitoring operation of and/or driving various elements of host machine 10. Module 522 incorporates suitable circuitry 712 for amplifying the output of sensors 225, 226, 227, 228 and 280, 281, 282 of sorter 14 and document handler 16 respectively; circuitry 713 for operating fuser release clutch 159; and circuitry 714 for operating main and auxiliary paper tray feed roll clutches 130, 131 and document handler feed clutch 244.

Additionally, fuser detection circuitry 715 monitors temperature conditions of fuser 150 as responded to by sensor 174. On overheating of fuser 150, a signal (FUS-OT) is generated to turn heater 163 off, actuate clutch 159 to separate fusing and pressure rolls 160, 161; trigger trap solenoid 158 to prevent entrance of the next copy sheet into fuser 150, and initiate a shutdown of host machine 10. Circuitry 715 also cycles fuser heater 163 to maintain fuser 150 at proper operating temperatures and signals (FUS-RDUT) host machine 10 when fuser 150 is ready for operation.

Circuitry 716 provides closed loop control over sensor 98 which responds to the presence of a copy sheet 3 on belt 20. On a signal from sensor 98, solenoid 97 is triggered to bring deflector 96 into intercepting position adjacent belt 20. At the same time, a backup timer (not shown) is actuated. If the sheet is lifted from the belt 20 by deflector 96 within the time allotted, a signal from sensor 99 disables the timer and a misstrip type jam condition of host machine 10 is declared and the machine is stopped. If the signal from sensor 99 is not received within the allotted time, a sheet on selenium (SOS) type jam is declared and an immediate machine stop is effected.

Circuitry 718 controls the position (and hence the image reduction effected) by the various optical elements that comprise main lens 41 in response to the reduction mode selected by the operator and the signal inputs from lens position responsive sensors 116, 117, 118. The signal output of circuitry 718 serves to operate lens drive motor 43 as required to place the optical elements of lens 41 in proper position to effect the image reduction programmed by the operator.

Figure 15:
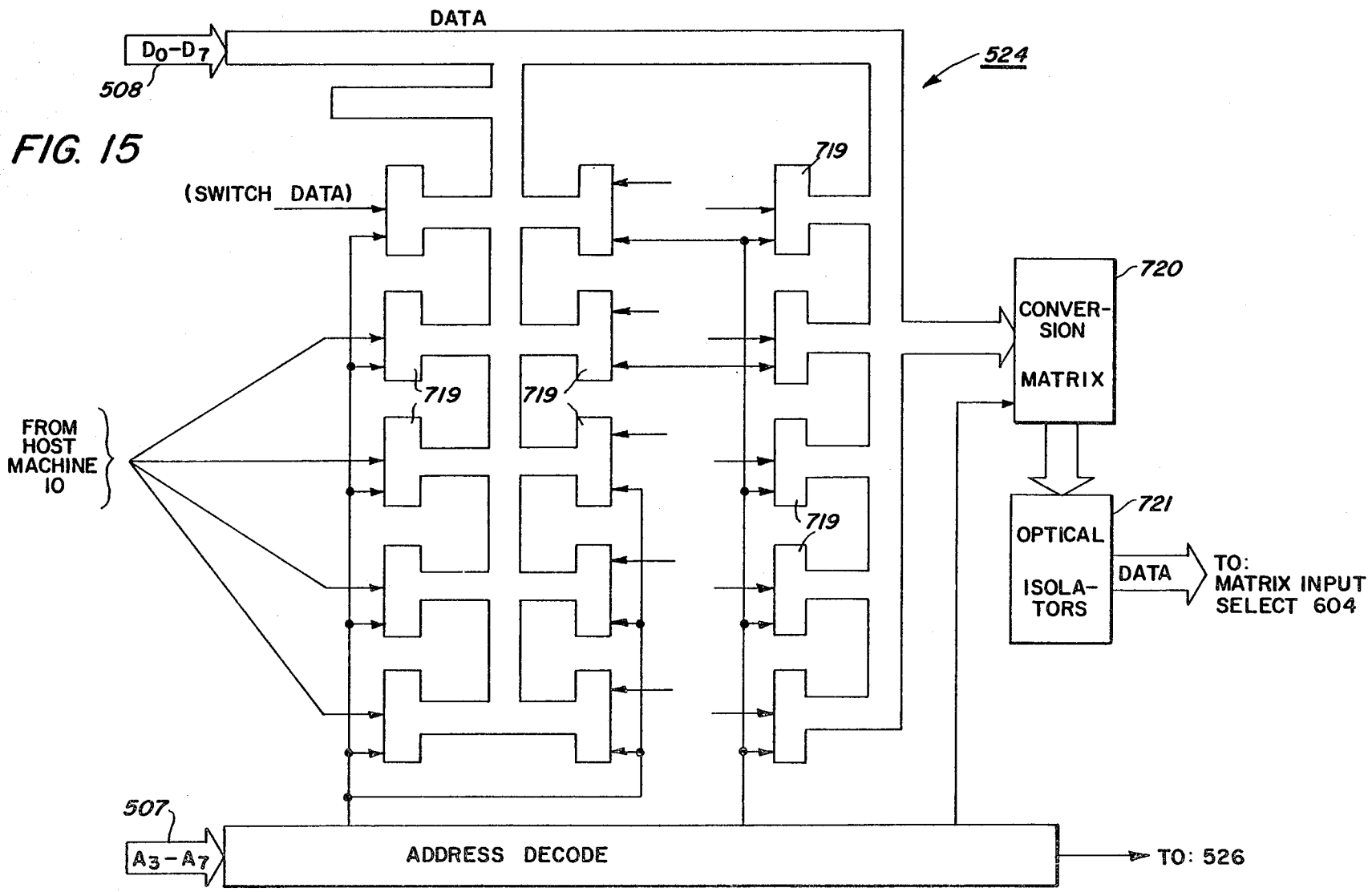
FIG. 15 is a block diagram of the main panel interface module.

Referring to FIG. 15, input matrix module 524 provides analog gates 719 for receiving data from the various host machine sensors and inputs (i.e. sheet sensors 135, 136; pressure sensor 157; etc), module 524 serving to convert the signal input to a byte oriented output for transmittal to I/O module 502 under control of Input Matrix Select 604. The byte output to module 524 is selected by address information inputted on bus 507 and decoded on module 524. Conversion matrix 720, which may comprise a diode array, converts the input logic signals of "0" to logic "1" true. Data from input matrix module 524 is transmitted via optical isolators 721 and Input Matrix Select 604 of I/O module 502 to CPU Module 500.

Figure 16:
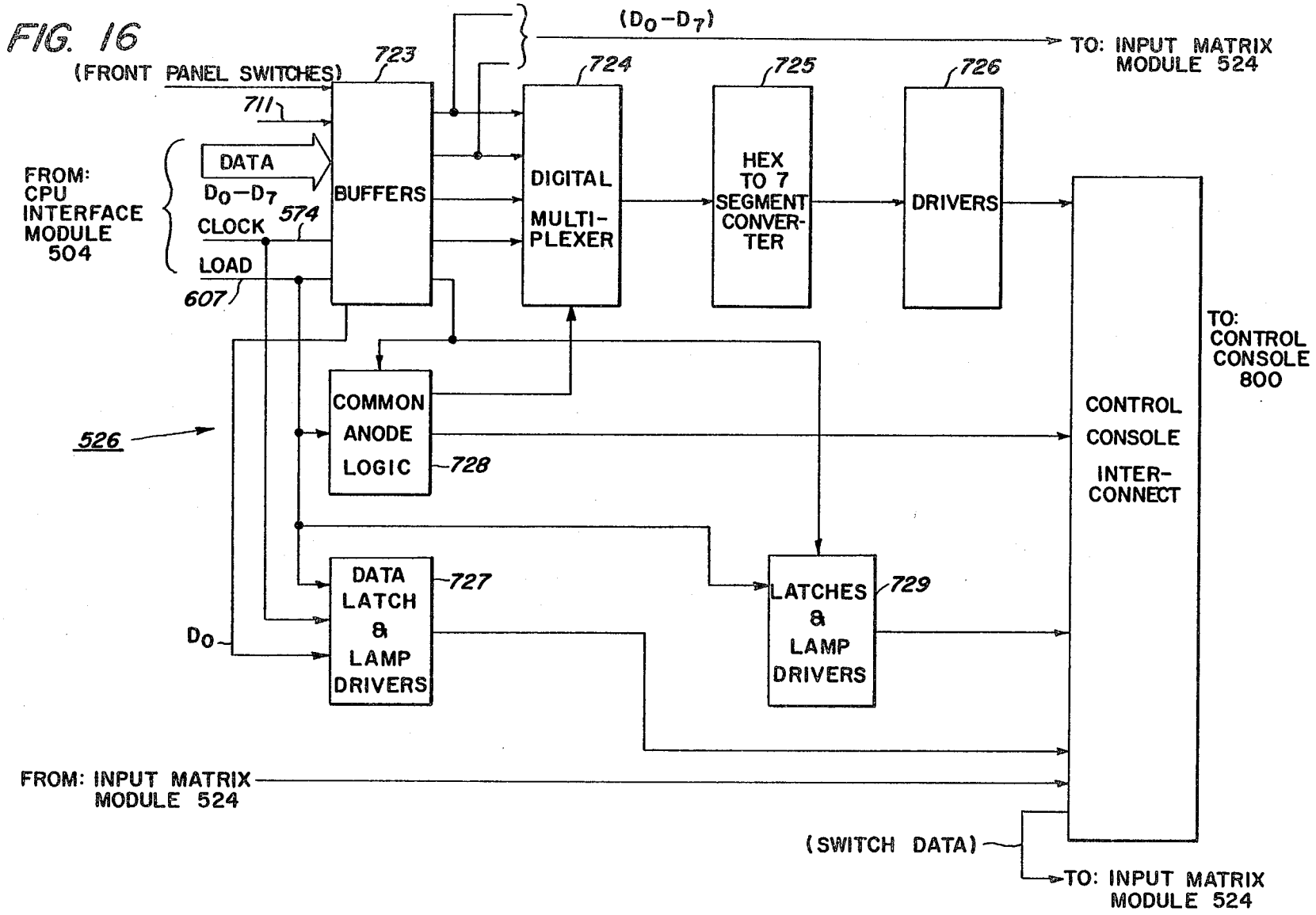
FIG. 16 is a block diagram of the input matrix module.

Referring particularly to FIG. 16, main panel interface module 526 serves as interface between CPU interface module 504 and operator control console 800 for display purposes and as interface between input matrix module 524 and the console switches. As described, data channels D0–D7 have data bits in each channel associated with the control console digital display or lamps. This data is clocked into buffer circuitry 723 and from there, for digital display, data in channels D1–D7 is inputted to multiplexer 724. Multiplexer 724 selectively multiplexes the data to HEX to 7 segment converter 725. Software controlled output drivers 726 are provided for each digit which enable the proper display digit in response to the data output of converter 725. This also provides blanking control for leading zero suppression or inter digit suppression.

Buffer circuitry 723 also enables through anode logic 728 the common digit anode drive. The signal (LOAD) to latch and lamp driver control circuit 729 regulates the length of the display cycle.

For console lamps 830, data in channel D0 is clocked to shift register 727 whose output is connected by drivers to the console lamps. Access by input matrix module 524 to the console switches and keyboard is through main panel interface module 526.

The machine output sections 530, 532, 534, 536, 538, 540 are interfaced with I/O module 502 by CPU interface module 504. At each interrupt/refresh cycle, data is outputted to sections 530, 532, 534, 536, 538, 540 at the clock signal rate in line 574 over data channels D2, D3, D4, D5, D6, D7 respectively.

Figure 17:
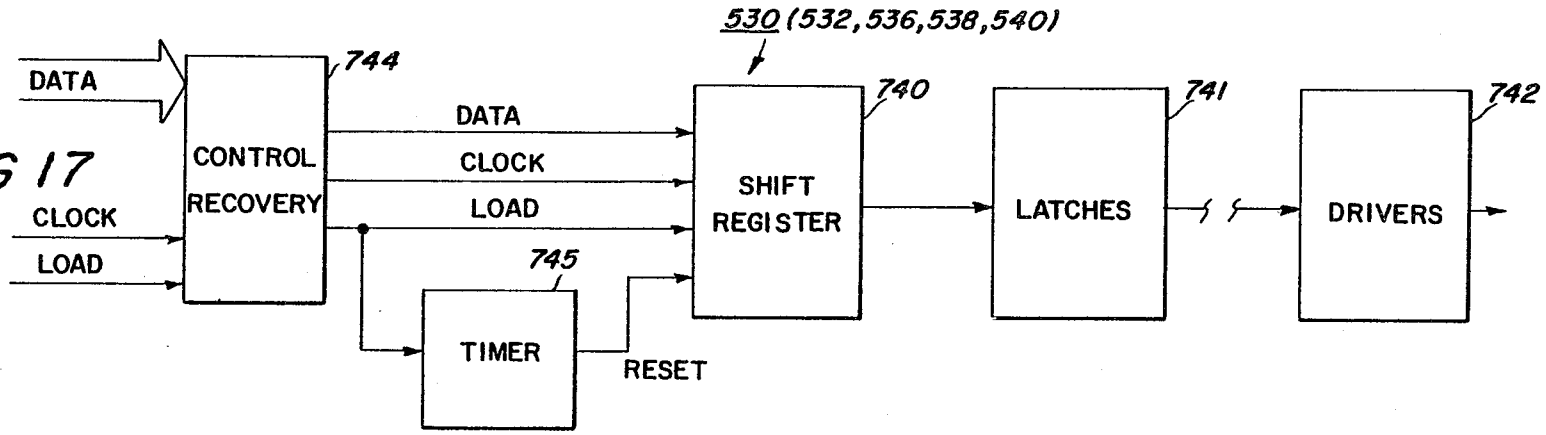
FIG. 17 is a block diagram of a typical remote.

Referring to FIG. 17, wherein a typical output section i.e. document handler section 530 is shown, data inputted to section 530 is stored in shift register/latch circuit combination 740, 741 pending output to the individual drivers 742 associated with each machine component. Preferably d.c. isolation between the output sections is maintained by the use of transformer coupled differential outputs and inputs for both data and clock signals and a shielded twisted conductor pair. Due to transformer coupling, the data must be restored to a d.c. waveform. For this purpose, control recovery circuitry 744, which may comprise an inverting/non-inverting digital comparator pair and output latch is provided.

The LOAD signal serves to lockout input of data to latches 741 while new data is being clocked into shift register 740. Removal of the LOAD signal enables commutation of the fresh data to latches 741. The LOAD signal also serves to start timer 745 which imposes a maximum time limit within which a refresh period (initiated by Refresh Control 605) must occur. If refresh does not occur within the prescribed time limit, timer 745 generates a signal (RESET) which sets shift register 740 to zero.

With the exception of sorter section 534 discussed below, output sections 532, 536, 538 and 540 are substantially identical to document handler section 530.

Figure 18:
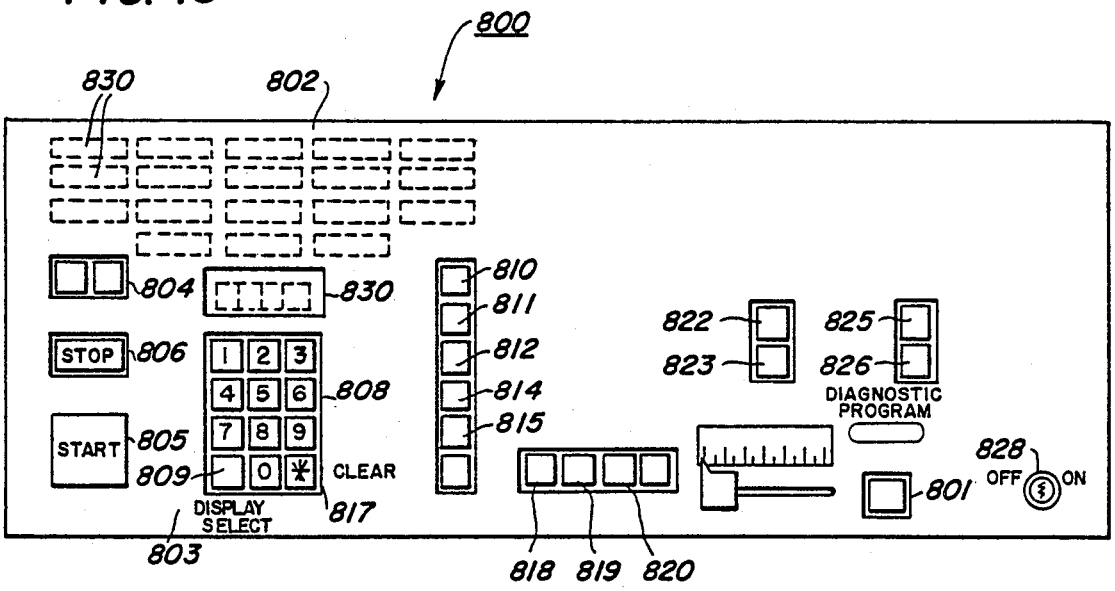
FIG. 18 is a view of the control console for inputting copy run instructions to the apparatus shown in FIG. 1.

Referring now to FIG. 18, control console 800 serves to enable the operator to program host machine 10 to perform the copy run or runs desired. At the same time, various indicators on console 800 reflect the operational condition of machine 10. Console 800 includes a bezel housing 802 suitably supported on host machine 10 at a convenient point with decorative front or face panel 803 on which the various machine programming buttons and indicators appear. Programming buttons include power on/off buttons 804, start print (PRINT) buttons 805, stop print (STOP) button 806 and keyboard copy quantity selector 808. A series of feature select buttons consisting of auxiliary paper tray button 810, two sided copy button 811, copy lighter button 814, and copy darker button 815, are provided.

Additionally, image size selector buttons 818, 819, 820; multiple or single document select buttons 822, 823 for operation of document handler 16; and sorter sets or stacks buttons 825, 826 are provided. An on/off service selector 828 is also provided for activation during machine servicing.

Indicators comprise program display lamps 830 and displays such as READY, WAIT, SIDE 1, SIDE 2, ADD PAPER, CHECK STATUS PANEL, PRESS FAULT CODE, QUANTITY COMPLETED, CHECK DOORS, UNLOAD AUX TRAY, CHECK DOCUMENT PATH, CHECK PAPER PATH, JOB INCOMPLETE and UNLOAD SORTER. Other display information may be envisioned.

MACHINE OPERATION

As will appear, host machine 10 is conveniently divided into a number of operational states. The machine control program is divided into background routines and Foreground routines with operational control normally residing in the Background routine or routines appropriate to the particular machine state then in effect. The output buffer 546′ of RAM memory section 546 is used to transfer/refresh control data to the various remote locations in host machine 10, control data from both Background and Foreground routines being inputted to buffer 546′ for subsequent transmittal to host machine 10. Transmittal/refresh of control data presently in output buffer 546′ is effected through Direct Memory access (DMA) under the aegis of a Machine Clock interrupt routine.

Foreground routine control data which includes a Run Event Table built in response to the particular copy run or runs programmed, is transferred to output buffer 546′ by means of a multiple prioritized interrupt system wherein the Background routine in process is temporarily interrupted while fresh Foreground routine control data is inputted to buffer 546′ following which the interrupted Background routine is resumed.

Referring particularly to FIG. 18, the machine operator uses control console 800 to program the machine for the copy run desired. Programming may be done during either the System Not Ready (NRDY) or System Ready (RDY) states, although the machine will not operate during the System Not ready state should START PRINT button 805 be pushed. The copy run includes selecting (using keyboard 808) the number of copies to be made, and such other ancillary program features as may be desired, i.e. use of auxiliary paper tray 102, (push button 810), image size selection (push buttons 818, 819, 820), document handler/sorter selection (push buttons 822, 823, 825, 826), copy density (push buttons 814, 815), duplex or two sided copy button 811, etc. On completion of the copy run program, START PRINT button 805 is actuated to start the copy run programmed (presuming the READY lamp is on and an original or originals 2 have been placed in tray 233 of document handler 16 if the document handler has been selected).

With programming of the copy run instructions, controller 18 enters a Digit Input routine in which the program information is transferred to RAM section 546. The copy run program data passes via Main Panel Interface Module 526 to Input Matrix Module 524 and from there is addressed through Matrix Input Select 604, Multiplexer 624, and Buffers 620 of I/O Module 502 to RAM section 546 of CPU Module 500.

On entering PRINT STATE, a Run Event Table comprised of Foreground tasks is built for operating in cooperation with the background tasks the various components of host machine 10 in an integrated manner to produce the copies programmed. The run Event Table is formed by controller 18 through merger of a Fixed Pitch Event Table (stored in ROM 545 and Non Volatile Memory 610) and a Variable Pitch Event Table in a fashion appropriate to the parameters of the job selected.

The Output Refresh cycle alluded to earlier functions, when entered, to transfer/refresh data from the output buffer of 546′ RAM section 546 to host machine 10. Direct Memory Access (DMA) is used to insure a high data transfer rate.

On a refresh, Refresh Control 605 (see FIG. 11*b*) raises the HOLD line to processor 542, which on completion of the operation then in progress, acknowledges by a HOLD A signal. With processor 542 in a hold mode and Address and Data buses 507, 508 released to I/O Module 502 (through operation of tri-state buffers 510, 511, 563, 570), the I/O module then sequentially accesses the output buffer 546′ of RAM section 546 and transfers the contents thereof to host machine 10. Data previously transferred is refreshed.

The Real Time Interrupt, which carries the lowest priority, is active in all machine states. Primarily, the interrupt acts as an interval timer by decrementing a series of timers which in turn serve to control initiation of specialized subroutines used for control and error checking purposes.

For further explanation of the mnemonics and particular instructions utilized by the following routines, the reader is directed to Intel Corporation's Programming Manual for the 8080 Microcomputer System.

TABLE I

```
151                          ****************************************************************************
152                          * COMMON SWITCH SCAN SUBR.  ENTER WITH SWITCH BYTE IN A-REG (FROM BIT 0R BYTE  *
153                          *   FILTERING SUBROUTINES), ADDR OF PRIOR SWITCH CONDITION BYTE IN MEMORY (H&L *
154                          *   REGS), AND E-REG SET TO SWITCH BYTE (AND 'CASE!' GROUP) NUMBER (5 TO 0).   *
155                          ****************************************************************************

157   05 0007D   47      A   SWSOSCAN MOV      B,A                          B= LATEST 'READ' DATA
158   05 0007E   7E      A           MOV      A,M                          A= PRIOR 'READ' DATA
159   05 0007F   70      A           MOV      M,B                          UPDATE 'PRIOR' TO 'LATEST'
160   05 00080   A8      A           MODBYT   A,XOR,B                      A= 1 WHERE SWS JUST CHANGED
161   05 00081   A0      A           IF!      XBYT,A,AND,B,NZ              WERE ANY SWS JUST PUSHED
      05 00082   CA5501  N
162   05 00085   26FF    A               MVI      H,X'FF'                  YES, INIT BIT POSITION CNTR
163                                    REPEAT                            LOOP 'UNTIL' NO BITS= 1 IN BYTE
164   05 00087   24      A                INR      H                       H= POSITION OF SW (D0 TO D7)
165   05 00088   17      A                RAL                              PUT SW INFO INTO 'C' BIT
166   05 00089   D25101  N                IF!      CC,C,S                  HAS THIS SW JUST BEEN PUSHED
167   05 0008C   F5      A                    PUSH     PSW                 YES, SAVE
168   05 0008D   D5      A                    PUSH     D                       REGS OVER
169   05 0008E   E5      A                    PUSH     H                           'CASE!'
170   05 0008F   7B      A                    MOV      A,E                 RELOAD 'BYTE #' CNTR
171   05 00090   E61F    A                    ANI      X'1F'               ELLIM.POSS.OF POSITIVE #
172   05 00092   07      A                    RLC                          MULTIPLE
173   05 00093   07      A                    RLC                                 A.REG
174   05 00094   07      A                    RLC                                     BY 8
175   05 00095   84      A                    CASE!    XBYT,A,ADD,H        USE BYTE # & BIT # AS A PNTR
      05 00096   114E01  N
      05 00099   FE58    A
      05 0009B   CD0000  N
```

```
177                                 ************************************************
178                                 * ACTIVE SWITCHES FOR STAND-BY (NOT READY & READY STATES)  *
179                                 ************************************************
180   05 0009E   0000   N                          C,00    DIGIT@IN     DIGIT 1
181   05 000A0   0000   N                          C,01    DIGIT@IN     DIGIT 2
182   05 000A2   0000   N                          C,02    DIGIT@IN     DIGIT 3
183   05 000A4   0000   N                          C,03    DIGIT@IN     DIGIT 4
184   05 000A6   0000   N                          C,04    DIGIT@IN     DIGIT 5
185   05 000A8   0000   N                          C,05    DIGIT@IN     DIGIT 6
186   05 000AA   0000   N                          C,06    DIGIT@IN     DIGIT 7
187   05 000AC   0000   N                          C,07    DIGIT@IN     DIGIT 8
188                                 *
189   05 000AE   0000   N                          C,08    DIGIT@IN     DIGIT 9
190   05 000B0   0000   N                          C,09    KYBD@0       DIGIT 0
191   05 000B2   0000   N                          C,10    RECALL@
192   05 000B4   0000   N                          C,11    @CLEAR       CLEAR
193   05 000B6   0000   N                          C,12    IMAG@SFT     IMAGE SHIFT
194   05 000B8   9301   N                          C,13    SPARE
195   05 000BA   0000   N                          C,14    STRT@PRT     START PRINT
196   05 000BC   0000   N                          C,15    ST@P@PRT     ST@P PRINT
197                                 *
198   05 000BE   0000   N                          C,16    VAR@DENS     VARIABLE DENSITY
199   05 000C0   0000   N                          C,17    AX@TRAY      AUX TRAY
200   05 000C2   9301   N                          C,18    SPARE
201   05 000C4   9301   N                          C,19    SPARE
202   05 000C6   9301   N                          C,20    SPARE
203   05 000C8   0000   N                          C,21    PEC@@N       PASTE UP SUPPRESSION
204   05 000CA   0000   N                          C,22    2SD@CPY      2 SIDED COPY
205   05 000CC   9301   N                          C,23    SPARE
206                                 *
207   05 000CE   9401   N                          C,24    RX
208   05 000D0   9401   N                          C,25    RX
209   05 000D2   9401   N                          C,26    RX
210   05 000D4   9401   N                          C,27    RX
211   05 000D6   0000   N                          C,28    98@REDN      98% REDUCTION
212   05 000D8   0000   N                          C,29    74@REDN      74% REDUCTION
213   05 000DA   0000   N                          C,30    65@REDN      65% REDUCTION
214   05 000DC   0000   N                          C,31    RX@Z@@M      RANK Z@@M LENS
215                                 *
216   05 000DE   0000   N                          C,32    ADH@JREC     ADH J@B RECOVERY
217   05 000E0   0000   N                          C,33    ADH@MULT     ADH MULTIPLE FEED
218   05 000E2   0000   N                          C,34    ADH@SGNL     ADH SINGLE FEED
219   05 000E4   9401   N                          C,35    RX
220   05 000E6   0000   N                          C,36    SRT@J@@S     S@RTER J@B SUPPLEMENT
221   05 000E8   0000   N                          C,37    SRT@SETS     S@RTER SETS
222   05 000EA   0000   N                          C,38    SRT@STKS     S@RTER STACKS
223   05 000EC   9301   N                          C,39    SPARE
224                                 *
225   05 000EE   9301   N                          C,40    SPARE
226   05 000F0   9301   N                          C,41    SPARE
227   05 000F2   9301   N                          C,42    SPARE
228   05 000F4   9301   N                          C,43    SPARE
229   05 000F6   0000   N                          C,44    SERVICE      TECH REP KEY SWITCH
230   05 000F8   0000   N                          C,45    FAULT@CD     DISPLAY FAULT C@DE
231   05 000FA   0000   N                          C,46    LVDGNPRG     LEAVE DIAGN@STIC PR@GRAM
232   05 000FC   9301   N                          C,47    SPARE

234                                 ********************************
235                                 * ACTIVE SWITCHES FOR PRINT STATE *
236                                 ********************************
237   05 000FE   0000   N                          C,48    RECALL@      RECALL QUANTITY
238   05 00100   0000   N                          C,49    ADH@PMUL     ADH MULTIPLE FEED
239   05 00102   0000   N                          C,50    ADH@PSIN     ADH SINGLE FEED
240   05 00104   9301   N                          C,51    SPARE
241   05 00106   0000   N                          C,52    SMPL@CPY     SAMPLE C@PY (START PRINT)
242   05 00108   0000   N                          C,53    PRT@ST@P     ST@P PRINT
243   05 0010A   0000   N                          C,54    CNTR@RST     DIAGN@STIC C@UNTER RESET
244   05 0010C   0000   N                          C,55    AX@PRNT      AUX TRAY
245                                 ************************************************
246                                 * ACTIVE SWITCHES FOR TECH REP (NOT READY,READY STATES)  *
247                                 ************************************************
248   05 0010E   0000   N                          C,56    DIGIT@TR     DIGIT 1
249   05 00110   0000   N                          C,57    DIGIT@TR     DIGIT 2
250   05 00112   0000   N                          C,58    DIGIT@TR     DIGIT 3
251   05 00114   0000   N                          C,59    DIGIT@TR     DIGIT 4
252   05 00116   0000   N                          C,60    DIGIT@TR     DIGIT 5
253   05 00118   0000   N                          C,61    DIGIT@TR     DIGIT 6
254   05 0011A   0000   N                          C,62    DIGIT@TR     DIGIT 7
255   05 0011C   0000   N                          C,63    DIGIT@TR     DIGIT 8
256                                 *
257   05 0011E   0000   N                          C,64    DIGIT@TR     DIGIT 9
258   05 00120   0000   N                          C,65    KYBD@@TR     DIGIT 0
259   05 00122   0000   N                          C,66    DRECALL@
260   05 00124   0000   N                          C,67    DCLEAR@
261   05 00126   0000   N                          C,68    SERVICE      TECH REP KEY SWITCH
262   05 00128   0000   N                          C,69    DIAG@PRG     DIAGN@STIC PR@GRAM
263   05 0012A   0000   N                          C,70    STRT@DG      START PRINT
264   05 0012C   0000   N                          C,71    ST@P@DG      ST@P PRINT
265                                 ************************************************
266                                 *  ACTIVE SWITCHES FOR MINI PHYSICAL (NOT READY & READY STATE)  *
267                                 ************************************************
268   05 0012E   0000   N                          C,72    MINI@MIS     MISFEED CLEAR
269   05 00130   0000   N                          C,73    RECALL@      RECALL QUANTITY
270   05 00132   9301   N                          C,74    SPARE
271   05 00134   0000   N                          C,75    FAULT@CD     DISPLAY FAULT C@DE
272   05 00136   0000   N                          C,76    LVDGNPRG     LEAVE DIAGN@STIC PR@GRAM
```

```
273  05 00138   0000    N                    C,77     MINI@PRT     MINI PHYSICAL AT PRINT
274  05 0013A   0000    N                    C,78     STOP@PRT     STOP PRINT
275  05 0013C   0000    N                    C,79     ADH@JREC     ADH JOB RECOVERY
276                                 ************************************************************
277                                 * ACTIVE SWITCHES FOR MINI PHYSICAL (PRINT STATE & RUNNOT PRINT STATE) *
278                                 ************************************************************
279  05 0013E   9301    N                    C,80     SPARE
280  05 00140   9301    N                    C,81     SPARE
281  05 00142   0000    N                    C,82     RECALL@      RECALL QUANTITY
282  05 00144   9301    N                    C,83     SPARE
283  05 00146   9301    N                    C,84     SPARE
284  05 00148   9301    N                    C,85     SPARE
285  05 0014A   9301    N                    C,86     SPARE
286  05 0014C   0000    N                    C,87     PRT@STOP     STOP PRINT
287                                       ENDCASE
288  05 0014E   E1      A                    POP      H            RESTORE
289  05 0014F   D1      A                    POP      D                  SAVED
290  05 00150   F1      A                    POP      PSW                      REGS
291                                     ENDIF
292  05 00151   B7      A              UNTIL!    XBYT,A,OR,A,Z    END WHEN NO BITS IN THIS BYTE
     05 00152   C28700  N
293                                 ENDIF
294  05 00155   C9      A           RET                           RETURN TO STDBY OR PRINT BKGND
```

TABLE II

```
328                                 *
329                                 * ROUTINE CALLED BY SWITCH SCAN WHEN DIAGNOSTIC PROGRAM BUTTON IS PUSHED
330                                 * IN NON TECH REP STATES
331                                 *
332  05 001F4   3A4EFA  N  LVDGNPRG IF!       VBYT,DGN@NUM,NZ      IS THERE AN ACTIVE DGN PROGRAM
     05 001F7   A7      A
     05 001F8   CA0102  N
333  05 001FB   CD2703  N              CALL      DGN@ABT          ABORT OPERATING DGN PRG
334  05 001FE   C30602  N          ELSE!
335  05 00201   3E80    A              SFLG      SER@ACT          SIGNAL STCK TO GO TO TECH-REP
     05 00203   3249F4  A
336                                 ENDIF
337  05 00206   C9      A           RET
338                                 *
339                                 *        ROUTINE CALLED WHEN SERVICE KEY IS TURNED 'ON'
340                                 *
341  05 00207   CD0000  N  SERVICE  STIMR     KEY@REL,250,KEY@OFF  LOOK FOR KEY RELEASE
     05 0020A   45      A
     05 0020B   19      A
     05 0020C   2A02    N
342  05 0020E   3A1BF4  A           IF!       FLG,DGN@ERR,T        IS THERE ERROR PENDING
     05 00211   07      A
     05 00212   D22902  N
343  05 00215   3A4EFA  N           ANDIF!    VBYT,DGN@NUM,Z       WAS IT A PROGRAM # ENTRY ERROR
     05 00218   A7      A
     05 00219   C22902  N
344  05 0021C   3A4FFA  N              LDA       DG@SAV
345  05 0021F   326DFC  N              STA       DG@DIGIT         PUT DISPLAY BACK
346  05 00222   AF      A              CFLG      DGN@ERR          CANCEL ERROR
     05 00223   321BF4  A
347  05 00226   CD4101  N              CALL      DIAG@PRG         GIVE NUMBER RETRY FOR VALID
348                                 *                             ENTRY
349                                 ENDIF
350  05 00229   C9      A           RET
351                                 *
352                                 *        ROUTINE CALLED TO LOOK FOR KEY TURN OFF
353                                 *
354  05 0022A   2E2B    A  KEY@OFF  IF!       !BIT,SERVICE#,T
     05 0022C   CD0000  N
     05 0022F   D23C02  N
355  05 00232   CD0000  N              STIMR     KEY@REL,250,KEY@OFF  KEY STILL ON
     05 00235   45      A
     05 00236   19      A
     05 00237   2A02    N
356  05 00239   C35E02  N           ORIF!     VBYT,DGN@NUM,NZ      IS DGN PROGRAM ACTIVE
     05 0023C   3A4EFA  N
     05 0023F   A7      A
     05 00240   CA5E02  N
357  05 00243   CD7103  N              CALL      NVTBOCK
358  05 00246   CA5E02  N              IF!       CC,Z,C           CLEAR IF NOT DISCLOSED
359  05 00249   3A53FD  N                 IF!       XBYT,STATE!,LT,!PRNT  IS IT A RUNNING STATE
     05 0024C   FE04    A
     05 0024E   D25702  N
360  05 00251   CD2703  N                    CALL      DGN@ABT      YES ABORT DIAGNOSTIC PROGRAM
361  05 00254   C35E02  N                 ELSE!
362  05 00257   CD0000  N                    STIMR     KEY@REL,250,KEY@OFF KEEP LOOKING AT KEY RELEASE
     05 0025A   45      A
     05 0025C   2A02    N
363                                 *                             UNTIL MACHINE STOPS
364                                     ENDIF
365                                 ENDIF
366                                 ENDIF
367  05 0025E   C9      A           RET
368                                 *
369                                 *        ROUTINE CALLED IN TECH-REP STATE PROLOGUE
370                                 *
371  05 0025F   CDCB02  N  DGN@PRL  CALL      DSPL@DC              PUT DC-- IN DISPLAY
```

```
372   05 00262   3E80     A          SFLG     DSPLØDGN                 USE DIAGNØSTIC DISPLAY
      05 00264   321FF4   A
373   05 00267   3A63FC   N          LDA      PREVØIN+1
374   05 0026A   F604     A          ØRI      X'04'                    INHIBIT IMMEDIATE CALL TØ
375   05 0026C   3263FC   N          STA      PREVØIN+1                DIAGØPRG
376   05 0026F   C9       A          RET
377                                *
```

TABLE III

```
272                                *
273                                *
274                                * RØUTINE CALLED BY SWITCH SCAN WHEN DIAGNØSTIC PRØGRAM BUTTØN IS PUSHED
275                                * IN TECH REP STATE ØNLY
276                                *
277   05 00141   3A4EFA   N  DIAGØPRG IF:      VBYT,DGNØNUM,NZ          IS DGN PRØGRAM ACTIVE
      05 00144   A7       A
      05 00145   CA7A01   N
278   05 00148   3A53FD   N            IF:       XBYT,STATE:,EQ,:CØMP   IS IT CØMP CTRL STATE
      05 0014B   FE00     A
      05 0014D   C25601   N
279   05 00150   CD0000   N                CALL      CØMP:CHG           TELL STATE CK TØ GØ TØ TRP
280   05 00153   C37701   N            ELSE:
281   05 00156   CD0000   N                CTIMR     DSPLØTIM           CLEAR DIAG PRG 20,21,22 TIMER
      05 00159   4A       A
282   05 0015A   AF       A                XRA       A
283   05 0015B   326EFB   N                STA       FALTØPTR           SET UP FØR RESTART ØF PRG. 20
284   05 0015E   3A4EFA   N                IF:       XBYT,DGNØNUM,NE,DGNPRG29 DIAG 29 NØT ACTIVE
      05 00161   FE10     A
      05 00163   CA7101   N
285   05 00166   3A4EFA   N                ANDIF:    XBYT,DGNØNUM,NE,DGNPRG28 DIAG 28 NØT ACTIVE
      05 00169   FE0F     A
      05 0016B   CA7101   N
286   05 0016E   C37401   N                ELSE:                        CLEAN UP ØPERATING ADH DIAGNØST
287   05 00171   CD0000   N                     CALL      ADH29EPL     ABØRT ADH SKEW TEST
288                                        ENDIF
289   05 00174   CDCB02   N                CALL      DSPLØDC            PUT DC-- IN DISPLAY
290                                    ENDIF
291   05 00177   C3F301   N        ØRIF:     FLG,DGNØERR,T              IF ERRØR IS PENDING
      05 0017A   3A18F4   A
      05 0017D   07       A
      05 0017E   D28701   N
292   05 00181   CDCB02   N            CALL      DSPLØDC                PUT DC-- IN DISPLAY
293   05 00184   C3F301   N        ØRIF:     XWRD,DGNØDSPL,EQ,X'DC00'
      05 00187   1100DC   A
      05 0018A   2A6BFC   N
      05 0018D   CD0000   N
      05 00190   C29A01   N
294   05 00193   AF       A            CFLG      SERØACT                EXIT TECH REP STATE
      05 00194   3249F4   A
295   05 00197   C3F301   N        ELSE:
296   05 0019A   2600     A            MVI       H,0
297   05 0019C   CD0000   N            CALL      4BCD:BIN               CØNVERT TØ BINARY
298   05 0019F   7D       A            IF:       XBYT,L,GE,LSTØKEY+1
      05 001A0   FE25     A
      05 001A2   DAA801   N
299   05 001A5   C3C101   N            ØRIF:     XBYT,A,LT,1STØNKEY
      05 001A8   FE0A     A
      05 001AA   D2B101   N
300   05 001AD   3F       A                CMC
301   05 001AE   C3C101   N            ØRIF:     XBYT,A,GE,1STØKEY
      05 001B1   FE14     A
      05 001B3   DABC01   N
302   05 001B6   D604     A                SUI       1STØKEY-LSTØNKEY-1
303   05 001B8   3F       A                CMC
304   05 001B9   C3C101   N            ØRIF:     XBYT,A,GE,LSTØNKEY+1
      05 001BC   FE10     A
305                                    ENDIF
306   05 001C1   DACA01   N            IF:       CC,C,C
307   05 001C4   CDAE02   N                CALL      DSPLØERR           BAD ENTRY BLINK DISPLAY
308   05 001C7   C3F301   N            ELSE:
309   05 001CA   D609     A                SUI       9
310   05 001CC   47       A                MØV       B,A
311   05 001CD   CD7103   N                CALL      NVTBØCK            IS THIS ENTRY DISCLØSED YET
312   05 001D0   CAE101   N                IF:       CC,Z,C             CLEAR IF NØT DISCLØSED
313   05 001D3   2E2B     A                ANDIF:    IBIT,SERVICE#,F
      05 001D5   CD0000   N
      05 001D8   DAE101   N
314   05 001DB   CDAE02   N                     CALL      DSPLØERR      NØ,SHØW ERRØR
315   05 001DE   C3F301   N                ELSE:
316   05 001E1   78       A                     MØV       A,B
317   05 001E2   324EFA   N                     STA       DGNØNUM       USE NEW PRØGRAM NUMBER
318   05 001E5   CDEE02   N                     CALL      DSPLØCLR      BLANK THE DISPLAY
319   05 001E8   2121FC   A                     SFBIT,P   ØNØDIAG
      05 001EB   3E02     A
      05 001ED   B6       A
      05 001EE   77       A
320   05 001EF   AF       A                     XRA       A
321   05 001F0   326EFB   N                     STA       FALTØPTR      ,CAUSES 'FC' TØ BE DISP PRG 20
322                                *                                    TØ INDICATE PRØGRAM ACTIVE'
323                                            ENDIF
324                                        ENDIF
325                                    ENDIF
326   05 001F3   C9       A            RET
```

TABLE IV

```
473                                  *
474                                  *        ROUTINE TO DETERMINE IF DIAGNOSTIC PROGRAM HAS BEEN DISCLOSED BY
475                                  *        THE TECH-REP BY SEARCHING NV BYTE FOR ENABLE
476                                  *
477   05 00371   FE06     A   NVTBOCK  IF:       XBYT,A,LE,LSTONKEY-1STONKEY+1 IS IT DISCLOSURE RANGE
      05 00373   DA7903   N
      05 00376   C28503   N
478   05 00379   CD8603   N              CALL      NVOMASK                    BUILD MASK BASED ON A REG
479   05 0037C   E5       A              PUSH      H                          SAVE MASK
480   05 0037D   CD0000   N              RNVBYT    TRPODSCL                   GET DISCLOSED INFO
      05 00380   5F       A
      05 00381   E3       A
481   05 00382   E1       A              POP       H
482   05 00383   A4       A              MODBYT    A,AND,H                    IS MASK BIT FOUND IN DISCLOSURE
483   05 00384   94       A              MODBYT    A,SUB,H                    BYTE
484                                  ENDIF
485                                  *
486                                  *        ZERO CC IS CLEARED IF PROGRAM IS NOT DISCLOSED
487                                  *
488   05 00385   C9       A          RET
```

TABLE V

```
1236                                 *
1237                                 *        PROGRESSIVE DISCLOSURE DIAGNOSTIC PROGRAM USED BY THE TECH-REP
1238                                 *        TO GIVE ADVANCED OPERATORS ADDITIONAL DIAGNOSTIC CAPABILITY
1239                                 *
1240  05 00971   2A68FC   N   VALIDO33 LHLD      DGNODSPL                   WHAT IS IN DISPLAY
1241  05 00974   7C       A          IF:       VBYT,H,Z                   IS DISPLAY GT 99
      05 00975   A7       A
      05 00976   C29A09   N
1242  05 00979   7D       A          ANDIF:    XBYT,L,GE,1STONKEY+6
      05 0097A   FE10     A
      05 0097C   DA9A09   N
1243  05 0097F   FE16     A          ANDIF:    XBYT,A,LT,LSTONKEY+7
      05 00981   D29A09   N
1244  05 00984   D60F     A              SUI       15                         CONVERT TO BINARY AND SUB 9
1245  05 00986   47       A              MOV       B,A
1246  05 00987   CD8603   N              CALL      NVOMASK                    BUILD MASK FOR ENABLING
1247  05 0098A   E5       A              PUSH      H                          OR DISABLING REQUESTED PRG
1248  05 0098B   CD0000   N              RNVBYT    TRPODSCL
      05 0098E   5F       A
      05 0098F   E3       A
1249  05 00990   E1       A              POP       H                          H HAS MASK
1250  05 00991   6F       A              MOV       L,A
1251  05 00992   AF       A              XRA       A
1252  05 00993   3D       A              DCR       A                          CLEAR ZERO CONDITION CODE
1253  05 00994   3234F4   A              MODFLG    KYBDSINH                   INHIBIT KEYBOARD ENTRY
1254  05 00997   C39E09   N          ELSE:
1255  05 0099A   CDAE02   N              CALL      DSPLOERR                   BAD NUMBER BLINK DISPLAY
1256  05 0099D   AF       A              XRA       A                          SET ZERO CONDITION CODE
1257                                 ENDIF
1258  05 0099E   C9       A          RET
1259                                 *
1260                                 *        PROGRESSIVE DISCLOSURE BACKGROUND PROGRAM
1261                                 *
1262  05 0099F   3A2AF4   A   DGNOTO33 IF:       FLG,RCALLODG,T                IS RECALL REQUESTED
      05 009A2   07       A
      05 009A3   D2D109   N
1263  05 009A6   CD7109   N              CALL      VALIDO33
1264  05 009A9   CACE09   N              IF:       CC,Z,C                     CLEAR IF GOOD NUMBER
1265  05 009AC   2E00     A                  IF:       IBIT,RECALL#,T
      05 009AE   CD0000   N
      05 009B1   D2CB09   N
1266  05 009B4   78       A                      MOV       A,B
1267  05 009B5   CD7103   N                      CALL      NVTBOCK            CHECK IF IN TABLE
1268  05 009B8   C2C309   N                      IF:       CC,Z,S             SET IF IN TABLE
1269  05 009BB   CD0000   N                          SOBIT,S   READYO         TURN ON READY LIGHT
      05 009BE   E701     A
1270  05 009C0   C3C809   N                      ELSE:
1271  05 009C3   CD0000   N                          SOBIT,S   JOB$ICMP       TURN ON JOB INCOMPLETE
      05 009C6   F401     A
1272                                                 ENDIF
1273  05 009C8   C3CE09   N                  ELSE:
1274  05 009CB   CD6F00   N                      CALL      NOSDGN             TURN OFF READY LIGHT CLR RECALL
1275                                 *                                        FLAG
1276                                                 ENDIF
1277                                             ENDIF
1278  05 009CE   C30D0A   N          ORIF:     FLG,STRTODGN,T                IS START PRINT PUSHED
      05 009D1   3A3EF4   A
      05 009D4   07       A
      05 009D5   D2F009   N
1279  05 009D8   CD7109   N              CALL      VALIDO33
1280  05 009DB   CAED09   N              IF:       CC,Z,C                     CLEAR IF GOOD NUMBER
1281  05 009DE   7D       A                  MOV       A,L
```

```
1282  05 009DF   84       A                ORA      H                PUT NEWLY DISCLOSED PROGRAM
1283  05 009E0   325EE3   A                WNVBYT   TRPODSCL         IN NV TABLE
      05 009E3   0F       A
      05 009E4   0F       A
      05 009E5   0F       A
      05 009E6   0F       A
      05 009E7   325FE3   A
1284  05 009EA   CDEE02   N                CALL     DSPLOCLR         BUTTON PUSHED CLEAR DISPLAY
1285                                   ENDIF
1286  05 009ED   C30D0A   N            ORIF:     FLG,STOPODGN,T      IS STOP PRINT PUSHED
      05 009F0   3A33F4   A
      05 009F3   07       A
      05 009F4   D20D0A   N
1287  05 009F7   CD7109   N                CALL     VALIDO33         CLEAR IF GOOD NUMBER
1288  05 009FA   CA0D0A   N                IF:      CC,Z,C
1289  05 009FD   7C       A                MOV      A,H              PUT MASK IN A
1290  05 009FE   2F       A                CMA                       BUILD CANCEL MASK
1291  05 009FF   A5       A                ANA      L                CANCEL PROGRAM FROM TABLE
1292  05 00A00   325EE3   A                WNVBYT   TRPODSCL
      05 00A03   0F       A
      05 00A04   0F       A
      05 00A05   0F       A
      05 00A06   0F       A
      05 00A07   325FE3   A
1293  05 00A0A   CDEE02   N                CALL     DSPLOCLR         BUTTON PUSHED CLEAR DISPLAY
1294                                   ENDIF
1295                               ENDIF
1296  05 00A0D   CD9100   N            CALL      CLROCK
1297  05 00A10   C9       A            RET
```

TABLE VI

```
231                                 ***********************************************************************
232                                 * TECH REP DIGIT INPUT ROUTINE IS CALLED BY SWITCH SCAN IN THE TECH REP STATE *
233                                 * WHEN A NUMERIC KEY IS PUSHED ON THE PROGRAMMER KEYBOARD, THIS ROUTINE LOADS *
234                                 * A NUMBER INTO DGNODSPL WORD                                                *
235                                 ***********************************************************************

237  05 000F1   0F       A   DIGITOTR RRC                          RECOVER NUMBER FROM SWITCH SCAN
238  05 000F2   D637     A            SUI      55
239  05 000F4   5F       A            MOV      E,A
240  05 000F5   1600     A            MVI      D,0
241  05 000F7   3A34F4   A            IF:      FLG,KYBD5INH,F      IS THE ENTRY INHIBITED
     05 000FA   07       A
     05 000FB   DA4001   N
242  05 000FE   2A6BFC   N                LHLD     DGNODSPL         GET PREVIOUS VALUE
243  05 00101   7C       A                MOV      A,H
244  05 00102   29       A                DAD      H
245  05 00103   29       A                DAD      H
246  05 00104   29       A                DAD      H
247  05 00105   29       A                DAD      H                MULTIPLY PREVIOUS VALUE BY 10
248  05 00106   19       A                DAD      D                MERGE NEW UNITS DIGIT
249  05 00107   FEDC     A                IF:      XBYT,A,NE,X'DC'  IS IT DIAGNOSTIC PROGRAM ENTRY
     05 00109   CA2301   N
250  05 0010C   FEFC     A                ANDIF:   XBYT,A,NE,X'FC'  NO-IS IT PROG 20 OR 22 ENTRY
     05 0010E   CA2301   N
251  05 00111   CD0000   N                CALL     DIGOFIX          NO-JUST PLAIN OLD ENTRY
252  05 00114   47       A                MOV      B,A              SAVE DIGIT FIX RESULT
253  05 00115   FE0F     A                IF:      XBYT,A,EQ,X'0F'  IS DISPLAY FULL
     05 00117   C21F01   N
254  05 0011A   3E80     A                    SFLG     KYBD5INH     INHIBIT FURTHER ENTRY
     05 0011C   3234F4   A
255                                      ENDIF
256  05 0011F   78       A                MOV      A,B
257  05 00120   C33601   N                ELSE:
258  05 00123   67       A                MOV      H,A              PUT BACK 'DC' OR 'FC'
259  05 00124   7D       A                IF:      XBYT,L,GE,X'10'
     05 00125   FE10     A
     05 00127   DA3401   N
260  05 0012A   3E80     A                    SFLG     KYBD5INH     INHIBIT FURTHER ENTRY
     05 0012C   3234F4   A
261  05 0012F   3E0F     A                    MVI      A,X'0F'      ALL DIGITS ON
262  05 00131   C33601   N                ELSE:
263  05 00134   3E0D     A                    MVI      A,X'0D'      TENS DIGIT BLANK
264                                      ENDIF
265                                  ENDIF
266  05 00136   226BFC   N                SHLD     DGNODSPL         UPDATE MEMORY
267  05 00139   326DFC   N                STA      DGODIGIT         UPDATE MEMORY
268  05 0013C   AF       A                CFLG     DSPL01ST         UPDATE DISPLAY
     05 0013D   329AF4   A
269                               ENDIF
270  05 00140   C9       A        RET
```

TABLE VII

```
502  05 002CF   3A34F4   A   DGNOTO13 IF:      FLG,KYBD5INH,F      1ST TIME FOR DIAG #13
     05 002D2   07       A
     05 002D3   DAE302   N
```

```
503  05 002D6  3E80    A          SFLG      KYBD5INH          SET ONE TIME(INHIBIT KEYBOARD)
     05 002D8  3234F4  A
504  05 002DB  3E01    A          MVI       A,1
505  05 002DD  3283FA  N          STA       OUTPNTR           INITIALIZE PNTR TO LAST GAP TIM
506  05 002E0  C30B03  N       ORIF1     FLG,RCALLODG,T       DISPLAY SELECT SWITCH PUSHED
     05 002E3  3A2AF4  A
     05 002E6  07      A
     05 002E7  D2F602  N
507  05 002EA  AF      A          CFLG      RCALLODG          ACKNOWLEDGE PUSH
     05 002EB  322AF4  A
508  05 002EE  3E09    A          MVI       A,TABLNGTH        FETCH TABLE SIZE
509  05 002F0  CD1E03  N          CALL      ADHODINC          UPDATE DISPLAY
510  05 002F3  C30B03  N       ORIF1     FLG,STRTODGN,T       START PRINT PUSHED
     05 002F6  3A3EF4  A
     05 002F9  07      A
     05 002FA  D20B03  N
511  05 002FD  AF      A          CFLG      STRTODGN          ACKNOWLEDGE PUSH
     05 002FE  323EF4  A
512  05 00301  3A83FA  N          LDA       OUTPNTR           FETCH CURRENT GAP TIME IDENTIFI
513  05 00304  3D      A          DCR       A                 MOV ID TO NEXT GAP TIME PAIR
514  05 00305  CA0B03  N          IF1       CC,Z,C            NOT AT LAST GAP TIME
515  05 00308  CD1E03  N             CALL      ADHODINC       UPDATE DISPLAY
516                               ENDIF
517                            ENDIF
518  05 0030B  C9      A        RET
```

TABLE VIII

```
521                          *
522                          *     THE FOLLOWING TABLE DEFINES THE DISPLAYED GAP TIMES
523                          *           THE GAP TIME IS DEFINED AS:
524                          *           (ARGUMENT(2)+ARGUMENT(1))X10MS
525                          *           *NOTE:CODE GENERATED IS NOT NECESSARILY IN
526                          *                 THE SAME ORDER AS THE ARGUMENTS*
527                          *                 (SEE ORDITBL PROC DEFINITION)
528                          *

530                          ADHORDMT,TABO2 ORDITBL   ADHOCPDC,ADHRL3DC,)     1ST GAP TIME
531                                         ADHRL3DC,ADHOL4DC,)               2ND GAP TIME
532                                         ADHOL4DC,ADHRT3DC,)               3RD GAP TIME
533                                         ADHRT3DC,ADHOT4DC,)               4TH GAP TIME
534                                         ADHOSFDC,ADHFL3DC,)               5TH GAP TIME
535                                         ADHFL3DC,ADHOT2DC,)               6TH GAP TIME
536                                         ADHOT2DC,ADHFT3DC,)               7TH GAP TIME
537                                         ADHOT1DC,ADHOL1DC,)               8TH GAP TIME
538  05 0030C  CA      A                   ADHOSFDC,ADHOL2DC                 9TH GAP TIME
     05 0030D  C8      A
     05 0030E  C7      A
     05 0030F  C6      A
     05 00310  C5      A
     05 00311  C3      A
     05 00312  C2      A
     05 00313  C1      A
     05 00314  C0      A
     05 00315  C4      A
     05 00316  C9      A
     05 00317  C6      A
     05 00318  C5      A
     05 00319  C4      A
     05 0031A  C2      A
     05 0031B  C1      A
     05 0031C  C0      A
     05 0031D  BF      A
```

TABLE IX

```
540  05 0031E  3283FA  N  ADHODINC STA       OUTPNTR           UPDATE IDENTIFIER
541  05 00321  CD0000  N          STIMR     DSPLOTIM,510,ADHODSPL  UPDATE DISPLAY IN .5SEC
     05 00324  4A      A
     05 00325  33      A
     05 00326  3103    N
542  05 00328  CD0000  N          CALL      DSPLOCLR          BLANK THE DISPLAY
543  05 0032B  3E80    A          SFLG      KYBD5INH          RE-INHIBIT KEYBOARD
     05 0032D  3234F4  A
544  05 00330  C9      A          RET

546  05 00331  3A83FA  N  ADHODSPL LDA       OUTPNTR           FETCH IDENTIFIER
547  05 00334  2A78FB  N          LHLD      TAROSTRT          SET PNTR TO START OF CONTROL TA
548                               *                           (MINUS ONE)
549  05 00337  1600    A          MVI       D,0
550  05 00339  5F      A          MOV       E,A               SET PAIR TO ID OFFSET
551  05 0033A  19      A          DAD       D                 OFFSET PNTR TO CURRENT ID
552  05 0033B  46      A          MOV       B,M               SAV PRIOR DIAG CNTR OFFSET
553  05 0033C  1E09    A          MVI       E,TABLNGTH
554  05 0033E  19      A          DAD       D                 MOV PNTR TO 2ND PART OF CONTRL
555  05 0033F  6E      A          MOV       L,M               FETCH SUBSEQUENT DIAG CNTR OFFS
556  05 00340  26FC    A          MVI       H,HOADDR          MOV PNTR TO SUBSEQUENT DIAG CNT
```

```
557  05 00342  7E      A        MOV     A,M                      FETCH SUBSEQUENT DC TIME
558  05 00343  68      A        MOV     L,B                      MOV PNTR TO PRIOR DIAG CNTR
559  05 00344  96      A        SUB     M                        CALCULATE GAP TIME
560  05 00345  CD0000  N        CALL    BINR:BCD                 CONVERT TO BCD
561  05 00348  29      A        DAD     H
562  05 00349  29      A        DAD     H                        ADD TRAILING ZERO(MULTIPLY BY T
563  05 0034A  29      A        DAD     H
564  05 0034B  29      A        DAD     H
565  05 0034C  CD0000  N        CALL    DSPL@HL                  PUT GAP TIME IN DISPLAY
566  05 0034F  216DFC  N        LXI     H,DG@DIGIT               SET PNTR TO DIGIT DISPLAY ENABL
567  05 00352  3E01    A        MVI     A,00
568  05 00354  B6      A        ORA     M
569  05 00355  77      A        MOV     M,A                      ENABLE ZERO GAP TIME
570  05 00356  C9      A        RET
```

TABLE X

```
423  05 001CE  3A3EF4  A  DGN@T@28 IF:      FLG,STRT@DGN,T          START PRINT PUSHED
     05 001D1  07      A
     05 001D2  D21502  N
424  05 001D5  AF      A            CFLG      STRT@DGN              ACKNOWLEDGE PUSH
     05 001D6  323EF4  A
425  05 001D9  3A05F4  A            IF:       FLG,ADDR@ACT,T        ADH CLEARED
     05 001DC  07      A
     05 001DD  D21202  N
426  05 001E0  3A08F4  A            ANDIF:    FLG,ADH@MSEL,T        RE-SELECTED
     05 001E3  07      A
     05 001E4  D21202  N
427  05 001E7  3A8BF7  A            ANDIF:    FLG,ADH@NMOV,T        AND READY
     05 001EA  07      A
     05 001EB  D21202  N
428  05 001EE  AF      A                CFLG      ADDR@ACT          RESET SEQUENCE
     05 001EF  3205F4  A
429  05 001F2  2F      A                CMA
430  05 001F3  3234F4  A                MODFLG    KYBDSINH          INHIBIT KEYBOARD
431  05 001F6  2A6BFC  N                LHLD      DGN@DSPL          FETCH GAP TIME IDENTIFIER
432  05 001F9  7C      A                IF:       VBYT,H,Z
     05 001FA  A7      A
     05 001FB  C20F02  N
433  05 001FE  7D      A                ANDIF:    XBYT,L,LT,TABLNGTH+1  IDENTIFIER IN RANGE
     05 001FF  FE0A    A
     05 00201  D20F02  N
434  05 00204  3283FA  N                    STA       OUTPNTR       SAV IDENTIFIER OFFSET
435  05 00207  3EFF    A                    MVI       A,X'FF'       FETCH 'SET' MASK
436  05 00209  CD8602  N                    CALL      CYCLSTRT      START ADH RECYCLING
437  05 0020C  C31202  N                ELSE:                       IDENTIFIER OUT OF RANGE
438  05 0020F  CD0000  N                    CALL      DSPL@ERR
439                                     ENDIF
440                                 ENDIF
441  05 00212  C38502  N        ORIF:     FLG,STOP@DGN,T           STOP PRINT PUSHED
     05 00215  3A33F4  A
     05 00218  07      A
     05 00219  D22D02  N
442  05 0021C  AF      A            CFLG      STOP@DGN              ACKNOWLEDGE PUSH
     05 0021D  3233F4  A
443  05 00220  2F      A            CMA
444  05 00221  3205F4  A            MODFLG    ADDR@ACT              INDICATE ADH CLEARED
445  05 00224  CDC800  N            CALL      ADH@CLR               ABORT(CLEAR) ADH
446  05 00227  CD0000  N            CALL      DSPL@CLR              CLEAR DISPLAY
447  05 0022A  C38502  N        ORIF:     FLG,CLR@DGN,T            CLEAR SWITCH PUSHED
     05 0022D  3A16F4  A
     05 00230  07      A
     05 00231  D23E02  N
448  05 00234  AF      A            CFLG      CLR@DGN               ACKNOWLEDGE PUSH
     05 00235  3216F4  A
449  05 00238  CD9D00  N            CALL      ADH@MULT              SELECT ADH
450  05 0023B  C38502  N        ORIF:     FLG,RCALL@DG,T           DISPLAY SELECT PUSHED
     05 0023E  3A2AF4  A
     05 00241  07      A
     05 00242  D25902  N
451  05 00245  AF      A            CFLG      RCALL@DG              ACKNOWLEDGE PUSH
     05 00246  322AF4  A
452  05 00249  2F      A            CMA
453  05 0024A  3234F4  A            MODFLG    KYBDSINH              INHIBIT THE KEYBOARD
454  05 0024D  3A83FA  N            LDA       OUTPNTR               FETCH LAST IDENTIFIER
455  05 00250  2600    A            MVI       H,0
456  05 00252  6F      A            MOV       L,A
457  05 00253  CD0000  N            CALL      DSPL@HL               DISPLAY LAST IDENTIFIER
458  05 00256  C38502  N        ELSE:                              NO BUTTONS PUSHED
459  05 00259  CD9602  N            CALL      LMP@UPDT              UPDATE JOB+ICMP & READY+ LAMPS
460  05 0025C  3A07F4  A            IF:       FLG,ADH@JOBR,T        ADH CYCLE STARTED
     05 0025F  07      A
     05 00260  D28502  N
461  05 00263  3A83FA  N                LDA       OUTPNTR           FETCH CURRENT IDENTIFIER
462  05 00266  3D      A                DCR       A
463  05 00267  FA8502  N                IF:       CC,S,C            ID NOT ZERO
464  05 0026A  2A78FB  N                    LHLD      TAB@STRT      FETCH START OF CONTROL TABLE
465  05 0026D  111200  A                    LXI       D,TABLNGTH+2  SET OFFSET TO END OF CONTROL TA
466  05 00270  47      A                    MOV       B,A           SAV ID OFFSET
467  05 00271  7B      A                    MOV       A,E           MOV OFFSET TO SUBSEQUENT DIAGNO
468  05 00272  90      A                    SUB       B             COUNTER OF CURRENT GAP TIME PAI
469  05 00273  5F      A                    MOV       E,A
470  05 00274  19      A                    DAD       D             MOV PNTR TO SUBSEQUENT CNTR IN
```

```
471  05 00275  6E      A                MOV     L,M          SET PNTR TO ACTUAL
472  05 00276  26FC    A                MVI     H,HOADDR     SUBSEQUENT COUNTER
473  05 00278  3A84FA  N                LDA     ADHODGNL     FETCH LAST VALUE OF COUNTER
474  05 0027B  BE      A                IF:     XBYT,A,NE,M  HAS THERE BEEN A CHANGE
     05 0027C  CA8502  N
475  05 0027F  3284FA  N                    STA     ADHODGNL SAV NEW COUNTER VALUE
476  05 00282  CD3103  N                    CALL    ADHODSPL CALC & DISPLAY NEW GAP TIME
477                                     ENDIF
478                                 ENDIF
479                             ENDIF
480                         ENDIF
481  05 00285  C9      A            RET
```

TABLE XI

```
385  05 0015F  3A3EF4  A  DGNOT029 IF:      FLG,STRTODGN,T          START PRINT PUSHED
     05 00162  07      A
     05 00163  D2A101  N
386  05 00166  AF      A            CFLG      STRTODGN              ACKNOWLEDGE PUSH
     05 00167  323EF4  A
387  05 0016A  3A05F4  A            IF:       FLG,ADDROACT,T        ADH READY TO START  (SELECTED)
     05 0016D  07      A
     05 0016E  D29E01  N
388  05 00171  3A8BF7  A            ANDIF:    FLG,ADHONHOV,T        AND NO JAM PENDING
     05 00174  07      A
     05 00175  D29E01  N
389  05 00178  AF      A                CFLG      ADDROACT          CLEAR READY TILL NEXT SEQUENCE
     05 00179  3205F4  A
390  05 0017C  11B1F4  A                LXIFLG    D,ADHO29O1        SET PNTR TO 1ST HLT FLAG
391  05 0017F  2A6DFC  N                LHLD      DGNODSPL          FETCH STATION CODE
392  05 00182  2D      A                DCR       L                 JUSTIFY STATION CODE OFFSET
393  05 00183  7C      A                MOV       A,H
394  05 00184  B7      A                ORA       A                 CHECK MSBYT OF STATION CODE
395  05 00185  C29B01  N                IF:       CC,Z,S            MSBYT OF CODE ZERO
396  05 00188  7D      A                ANDIF:    XBYT,L,LT,MAXOCNT+1 LSBYT OF CODE IN RANGE(>0&<MAXC
     05 00189  FE05    A
     05 0018B  D29B01  N
397  05 0018E  19      A                    DAD       D             SET PNTR TO PROPER FLAG
398  05 0018F  3EFF    A                    MVI       A,X'FF'       FETCH 'SET' MASK
399  05 00191  77      A                    MOV       M,A           SET HLT FLAG
400  05 00192  3234F4  A                    MODFLG    KYBDSINH      INHIBIT KEYBOARD
401  05 00195  CD8602  N                    CALL      CYCLSTRT      START ADH RECYCLING
402  05 00198  C39E01  N                ELSE:                       STATION CODE OUT OF RANGE
403  05 0019B  CD0000  N                    CALL      DSPLOERR      START BLINKING THE DISPLAY
404                                     ENDIF
405                                 ENDIF
406  05 0019E  C3C901  N          ORIF:     FLG,STOPODGN,T          STOP PRINT PUSHED
     05 001A1  3A33F4  A
     05 001A4  07      A
     05 001A5  D2B901  N
407  05 001A8  AF      A            CFLG      STOPODGN              ACKNOWLEDGE PUSH
     05 001A9  3233F4  A
408  05 001AC  2F      A            CMA
409  05 001AD  3205F4  A            MODFLG    ADDROACT              INDICATE ADH READY FOR CYCLE (S
410  05 001B0  CDCB00  N            CALL      ADHOCLR               CANCELL OLD CYCLE
411  05 001B3  CD4B00  N            CALL      ADHOSGNL              RE-SELECT ADH
412  05 001B6  C3C901  N          ORIF:     FLG,CLRODGN,T           CLEAR SWITCH PUSHED
     05 001B9  3A16F4  A
     05 001BC  07      A
     05 001BD  D2C601  N
413  05 001C0  CD0000  N            CALL      DSPLOCLR              CLEAR THE DISPLAY
414  05 001C3  C3C901  N          ELSE:                             UPDATE FRONT PANEL LIGHTS
415  05 001C6  CD9602  N            CALL      LMPSUPDT              UPDATE JOBSICMP & READYS LAMPS
416                               ENDIF
417  05 001C9  C9      A          RET

419  05 001CA  CDCB00  N  ADH29EPL CALL      ADHOCLR                 CLEAR ADH
420  05 001CD  C9      A          RET
```

TABLE XII

```
854  05 00546  3AB0F4  A  ADHOCTRL IF:      FLG,ADHOSELC,T          ADH SELECTED
     05 00549  07      A
     05 0054A  D2E805  N
855  05 0054D  CDA004  N            CALL      SENOREAD              CHECK ADH INPUT SENSORS
856  05 00550  CAE505  N            IF:       CC,Z,C                CHANGE STATE IF SENSOR CHANGE
857  05 00553  57      A                MOV       D,A               SAVE CHANGE MASK IN D REG
858  05 00554  A0      A                ANA       B                 FIND LEAD EDGES
859  05 00555  5F      A                MOV       E,A               SAVE LEAD EDGES IN E REG
860  05 00556  2F      A                CMA
861  05 00557  A2      A                ANA       D                 FIND TRAIL EDGES
862  05 00558  21B9FC  N                LXI       H,TEDGINH         SET PNTR TO TEDG INHIBIT MASK
863  05 0055B  A6      A                ANA       M                 MASK OUT INHIBITED SENSORS
864  05 0055C  CA9E05  N                IF:       CC,Z,C            ANY TRAIL EDGES THIS READ
865  05 0055F  57      A                    MOV       D,A           SAVE TRAIL EDGES IN D REG
866  05 00560  23      A                    INX       H             MOV PNTR TO TEDG BYPASS MASK
```

```
05 00561   A6      A                    ANA     M                  MASK OUT INDETERMINENT TRAIL ED
05 00562   47      A                    MOV     B,A                SAVE VALID TRAIL EDGES
05 00563   23      A                    INX     H                  MOV PNTR TO TRAIL EDGE EXPECTED
05 00564   7E      A                    MOV     A,M                FETCH EXPECTED TRAIL EDGES
05 00565   2F      A                    CMA
05 00566   A0      A                    ANA     B                  COMPARE ACTUAL AND EXPECTED TRA
05 00567   C29605  N                    IF:     CC,Z,S             NO UNEXPECTED TRAIL EDGES
05 0056A   B2      A                        ORA     D              RESTORE TRAIL EDG BYE/SET CC FO
05 0056B   1600    A                        MVI     D,0            CLR CASE BRANCH TABLE POINTER
                                            REPEAT
05 0056D   17      A                            RAL
05 0056E   D28E05  N                            IF:     CC,C,S
05 00571   D5      A                                PUSH    D
05 00572   F5      A                                PUSH    PSW
05 00573   7A      A                                CASE:   VBYT,D
05 00574   118C05  N
05 00577   FE08    A
05 00579   CD0000  N
05 0057C   0108    N                                    C,0        TEDGFDOF FEED-OFF TRAIL EDGE ROUT
05 0057E   C408    N                                    C,1        TEDGWAIT WAIT TRAIL EDGE ROUTINE
05 00580   F308    N                                    C,2        TEDGRET RETURN TRAIL EDGE ROUTINE
05 00582   EE05    N                                    C,3        SPARE SPARE POSITION
05 00584   0208    N                                    C,4        TEDGEXIT EXIT TRAIL EDGE ROUTINE
05 00586   3A09    N                                    C,5        TEDGKICK KICK TRAIL EDGE ROUTINE
05 00588   EE05    N                                    C,6        SPARE SPARE POSITION
05 0058A   5409    N                                    C,7        TEDGIEMP INPUT EMPTY TRAIL EDGE R
                                                ENDCASE
05 0058C   F1      A                                POP     PSW
05 0058D   D1      A                                POP     D
                                                ENDIF
05 0058E   14      A                            INR     D          INCREMENT CASE TABLE POINTER
05 0058F   B7      A                            ORA     A          CHECK FOR ADDITIONAL TRAIL EDGE
05 00590   C26D05  N                        UNTIL:  CC,Z,S         LOOP UNTIL NO MORE TRAIL EDGES
05 00593   C39E05  N                    ELSE:
05 00596   2134FD  A                        LXIFBYT H,ADH11        SET PNTR TO PRIMARY FAULT BYTE
05 00599   B6      A                        ORA     M              SAVE INVALID TRAIL EDGES IN FAU
05 0059A   77      A                        MOV     M,A
05 0059B   CDA309  N                        CALL    ADHOABRT       ABORT ADH
                                        ENDIF
                                    ENDIF
05 0059E   7B      A                MOV     A,E
05 0059F   218CFC  N                LXI     H,LEDGINH              SET PNTR TO LEAD EDGE INHIBIT H
05 005A2   A6      A                ANA     M                      MASK OUT INHIBITED SENSORS
05 005A3   CAE505  N                IF:     CC,Z,C                 LEAD EDGES THIS READ
05 005A6   5F      A                    MOV     E,A                SAVE VALID LEAD EDGES
05 005A7   23      A                    INX     H                  MOV PNTR TO LEAD EDGE BYPASS HA
05 005A8   A6      A                    ANA     M                  MASK OUT INDETERMINENT LEAD EDG
05 005A9   47      A                    MOV     B,A                SAVE VALID LEAD EDGES IN B-REG
05 005AA   23      A                    INX     H                  MOV PNTR TO LEAD EDGE EXPECTED
05 005AB   7E      A                    MOV     A,M                FETCH EXPECTED LEAD EDGES
05 005AC   2F      A                    CMA
05 005AD   A0      A                    ANA     B                  COMPARE ACTUAL WITH EXPECTED LE
05 005AE   CABC05  N                    IF:     CC,Z,C
05 005B1   2134FD  A                        LXIFBYT H,ADH11        SET PNTR TO PRIMARY FAULT BYTE
05 005B4   B6      A                        ORA     M              SAVE INVALID LEAD EDGES
05 005B5   77      A                        MOV     M,A
05 005B6   CDA309  N                        CALL    ADHOABRT       ABORT ADH
05 005B9   C3E505  N                    ELSE:
05 005BC   B3      A                        ORA     E              FETCH LEAD EDGES (IF ANY)
05 005BD   1600    A                        MVI     D,0            SET POINTER TO ZERO
                                            REPEAT
05 005BF   17      A                            RAL
05 005C0   D2E005  N                            IF:     CC,C,S
05 005C3   5F      A                                MOV     E,A    SAVE LEAD EDGE BYTE
05 005C4   D5      A                                PUSH    D
05 005C5   7A      A                                CASE:   VBYT,D
05 005C6   11DE05  N
05 005C9   FE08    A
05 005CB   CD0000  N
05 005CE   0008    N                                    C,0        LEDGFDOF FEED-OFF LEAD EDGE ROUTI
05 005D0   5D07    N                                    C,1        LEDGWAIT WAIT LEAD EDGE ROUTINE
05 005D2   AF07    N                                    C,2        LEDGRET RETURN LEAD EDGE ROUTINE
05 005D4   EE05    N                                    C,3        SPARE SPARE POSITION
05 005D6   B206    N                                    C,4        LEDGEXIT EXIT LEAD EDGE ROUTINE
05 005D8   9207    N                                    C,5        LEDGKICK KICK LEAD EDGE ROUTINE
05 005DA   EE05    N                                    C,6        SPARE SPARE POSITION
05 005DC   CB07    N                                    C,7        LEDGIEMP INPUT EMPTY LEAD EDGE RO
                                                ENDCASE
05 005DE   D1      A                                POP     D
05 005DF   7B      A                                MOV     A,E    RESTORE LEAD EDGE BYTE
                                                ENDIF
05 005E0   14      A                            INR     D
05 005E1   B7      A                            ORA     A
05 005E2   C2BF05  N                        UNTIL:  CC,Z,S         LOOP UNTIL NO MORE LEAD EDGES
                                        ENDIF
                                    ENDIF
                                ENDIF
05 005E5   C3ED05  N            ELSE:                              ADH NOT SELECTED
05 005E8   3E80    A                SFLG    ADHONMOV               INDICATE NO ADH PROBLEMS
05 005EA   32BBF7  A
                                ENDIF
05 005ED   C9      A            RET

05 005EE   C9      A   SPARE    RET                                DUMMY ROUTINE FOR CASE TABLES
```

TABLE XIII

```
1082                    *      ************************************
1083                    *      *                                  *
1084                    *      *  LEDGEXIT:ROUTINE CALLED WHEN LEAD  *
1085                    *      *    EDGE IS DETECTED AT EXIT SENSOR  *
1086                    *      *    IF PAPER IS MOVING FORWARD THE   *
1087                    *      *    WAIT SENSOR IS ENABLED,THE FEED  *
1088                    *      *    COUNTER IS PULSED,AND THE MISFEED *
1089                    *      *    AND TO LONG OVER EXIT TIMING SEQ *
1090                    *      *    ARE STARTED. THE SLOW WAIT TO EXIT*
1091                    *      *    TIMING SEQUENCE IS STOPPED.      *
1092                    *      *    IF MOVING REVERSE,ORIGINALS FLASH *
1093                    *      *    ED IS UPDATED,SLOW-OFF FAULT SEQ *
1094                    *      *    IS STOPPED,SLOW EXIT TO RETURN SEQ*
1095                    *      *    IS STARTED AND THE PATTERS ARE   *
1096                    *      *    TURNED ON                        *
1097                    *      *                                     *
1098                    *      ************************************

1100  05 006B2  3A04F4  A  LEDGEXIT IF:     FLG,ADH0FORW,T          DOCUMENT MOVING FORWARD
      05 006B5  07       A
      05 006B6  D22007   N
1101  05 006B9  3AB1F4   A            IF:      FLG,ADH02981,F      NO DIAGNOSTIC ABORT PENDING
      05 006BC  07       A
      05 006BD  DA1607   N
1102  05 006C0  21EEFF   A                SOBIT    ADH0WT          ENABLE WAIT SENSOR
      05 006C3  3E02     A
      05 006C5  F3       A
      05 006C6  B6       A
      05 006C7  77       A
      05 006C8  FB       A
1103  05 006C9  21E8FF   A                SOBIT    ADH0FDCT        START FEED COUNT PULSE
      05 006CC  3E04     A
      05 006CE  F3       A
      05 006CF  B6       A
      05 006D0  77       A
      05 006D1  FB       A
1104  05 006D2  2A60FB   N                LHLD     TLT0A0FD
1105  05 006D5  CD0000   N                CALL     BCD0INC         INCREMENT SOFTWARE FEED COUNTER
1106  05 006D8  2260FB   N                SHLD     TLT0A0FD
1107  05 006DB  CD0000   N                CTIMR    ADH00           STOP SLOW WAIT TO EXIT
      05 006DE  00       A
1108  05 006DF  CD0000   N                CTIMR    ADH06           STOP SLOW OUT FAULT TIMER
      05 006E2  06       A
1109  05 006E3  CD0000   N                STIMR    ADH01,350,EXIT0FLT  START TO LONG OVER EXIT SEQ OF
      05 006E6  01       A
      05 006E7  23       A
      05 006E8  E109     N
1110  05 006EA  CD0000   N                STIMR    ADH02,800,MISSFEED  START MISFEED SEQUENCE OF 800MS
      05 006ED  02       A
      05 006EE  50       A
      05 006EF  2D0A     N
1111  05 006F1  CD0000   N                STIMR    ADH03,200,MULTFEED  ALLOW 200MS TO CLEAR WAIT SENSO
      05 006F4  03       A
      05 006F5  14       A
      05 006F6  850A     N
1112  05 006F8  3A50FD   N                DIAG0CT  ADHFL30C        SAVE LEDG EXIT(FORWARD PATH) TI
      05 006FB  32C5FC   N
1113  05 006FE  21BAFC   N                LXI      H,TEDGMASK      SET PNTR TO TRAIL EDGE MASK
1114  05 00701  3EFB     A                MVI      A,ADH0L3FM
1115  05 00703  A6       A                ANA      M               BYPASS TRAIL EDGE AT KICK
1116  05 00704  77       A                MOV      M,A
1117  05 00705  23       A                INX      H               MOV PNTR TO EXPECTED TRAIL EDGE
1118  05 00706  3640     A                MVI      M,ADH0L3F       EXPECTED TRAIL EDGE AT WAIT
1119  05 00708  21B9FC   N                LXI      H,TEDGINH
1120  05 00709  3E44     A                MVI      A,WAIT&21KICK01
1121  05 0070D  B6       A                ORA      M               ENABLE TRAIL EDGES AT WAIT & KI
1122  05 0070E  77       A                MOV      M,A             (CANCEL HOLE BYPASS)
1123  05 0070F  AF       A                XRA      A
1124  05 00710  328EFC   N                STA      LEDGEXPT        CANCEL EXPECTED LEAD EDGE AT EX
1125  05 00713  C31D07   N            ELSE:                       VALID HALT FLAG SET
1126  05 00716  AF       A                CFLG     ADH02981        CLEAN UP HALT FLAG
      05 00717  32B1F4   A
1127  05 0071A  CDA309   N                CALL     ADH0ABRT        STOP ORIGINAL
1128                                  ENDIF
1129                    *          DOCUEMENT MOVING ON REVERSE PATH
1130  05 0071D  C35C07   N        ORIF:    FLG,ADH02985,F          NO ABORT PENDING FOR REVERSE
      05 00720  3AB5F4   A
      05 00723  07       A
      05 00724  DA5507   N
1131  05 00727  21F7FF   A            SOBIT    ADH0PATT            START PATTERS
      05 0072A  3E08     A
      05 0072C  F3       A
      05 0072D  B6       A
      05 0072E  77       A
      05 0072F  FB       A
1132  05 00730  CD0000   N            CTIMR    ADH04               STOP SLOW-OFF SEQUENCE
      05 00733  04       A
1133  05 00734  CD0000   N            STIMR    ADH05,300,EXT0RET   START EXIT TO RETURN SEQ OF 300
      05 00737  05       A
      05 00738  1E       A
      05 00739  B00A     N
```

```
1134   05 00738   CD0000   N        STIMR     ADH@1,350,REXT@FLT     ALLOW 350MS TO CLEAR EXIT SENSO
       05 0073E   01       A
       05 0073F   23       A
       05 00740   DFCA     N
1135   05 00742   3A5CFD   N        DIAG@CT   ADHRL3DC               SAVE LEDG EXIT(REVERSE PATH) TI
       05 00745   32C0FC   N
1136   05 00748   3E20     A        MVI       A,ADH@L3R
1137   05 0074A   328EFC   N        STA       LEDGEXPT               EXPECT LEAD EDGE AT RETURN
1138   05 0074D   3E08     A        MVI       A,EXIT@3
1139   05 0074F   328BFC   N        STA       TEDGEXPT               EXPECT TRAIL EDGE AT EXIT
1140   05 00752   C35C07   N     ELSE:                               STOP DOCUEMENT ON REVERSE PATH
1141   05 00755   AF       A        CFLG      ADH@2905               CLEAN UP HALT FLAG
       05 00756   3285F4   A
1142   05 00759   CDA309   N        CALL      ADH@ABRT               HALT ADH
1143                             ENDIF
1144   05 0075C   C9       A     RET
```

Referring to FIG. 18, the appropriate button of copy selector 808 is set for the number of copies desired, i.e. 3 and document handler button 822, sorter select button 825 and two sided (duplex) button 811 depressed. The originals, in this case, two simplex or one-sided originals are loaded into tray 233 of document handler 16 (FIG. 4) and the Print button 805 depressed. On depression of button 805, the host machine 10 enters the PRINT state and the Run Event Table for the exemplary copy run programmed is built by controller 18 and stored in RAM section 546. As described, the Run Event Table together with Background routines serve, via the multiple interrupt system and output refresh (through D.M.A.) to operate the various components of host machine 10 in integrated timed relationship to produce the copies programmed.

Figure 19:
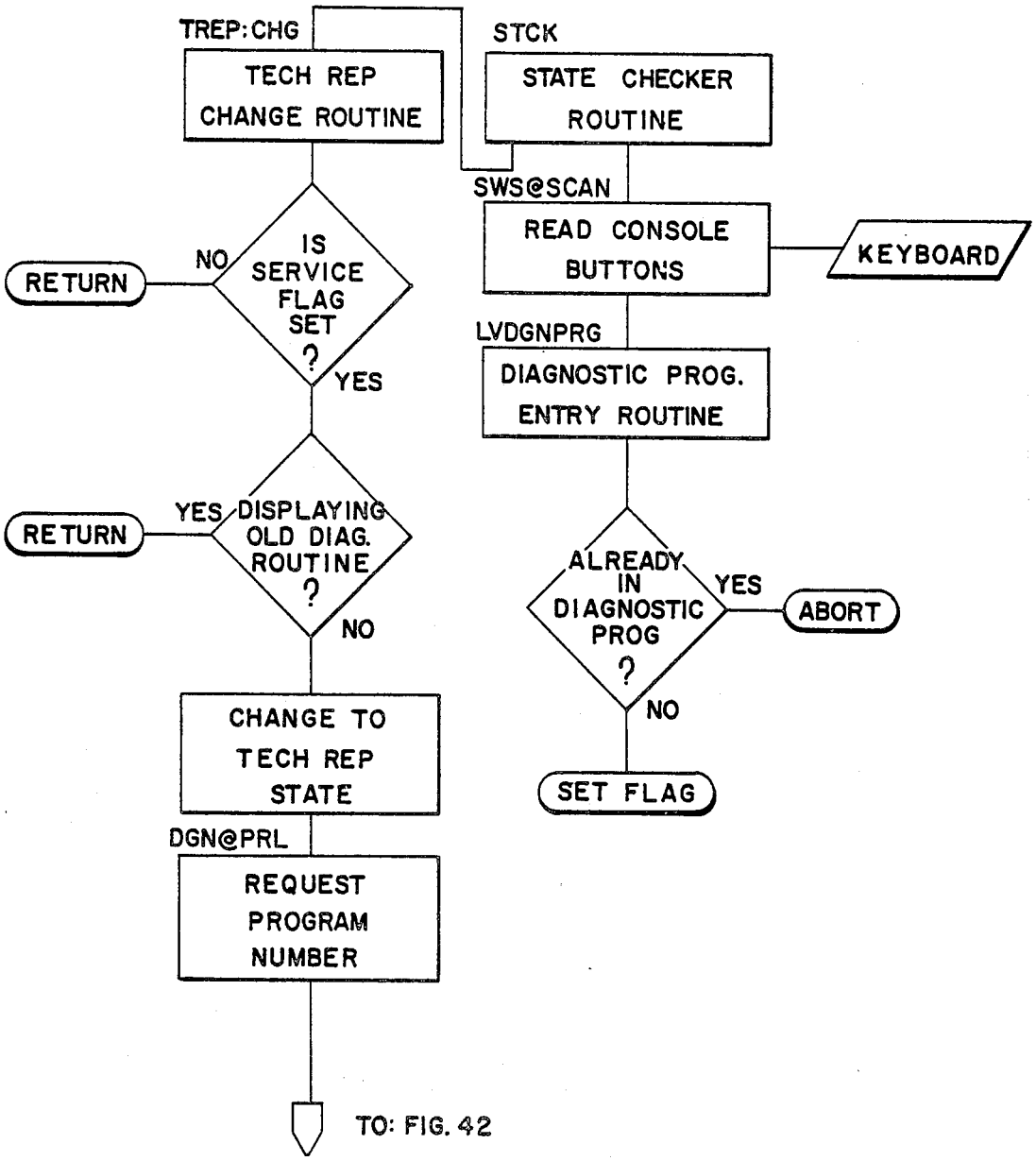
FIGS. 19, 20, 21, 22 are flow charts which illustrate the sequence of events for entering the machine into a diagnostic program, as well as determining whether the user has access to the particular program requested.

During the run, the first original is advanced onto platen 35 by document handler 16 where, as seen in FIG. 19, three exposures (1ST FLASH SIDE 1) are made producing three latent electrostatic images on belt 20 in succession. As described earlier, the images are developed at developing station 28 and transferred to individual copy sheets fed forward (1ST FEED SIDE 1) from main paper tray 100. The sheets bearing the images are carried from the transfer roll/belt nip by vacuum transport 155 to fuser 150 where the images are fixed. Following fusing, the copy sheets are routed by deflector 184 (referred to as an inverter gate in the tables) to return transport 182 and carried to auxiliary tray 102. The image bearing sheets entering tray 102 are aligned by edge pattern 187 in preparation for refeeding thereof.

Following delivery of the last copy sheet to auxiliary tray 102, the document header 16 is activated to remove the first original from platen 35 and bring the second original into registered position on platen 35. The second original is exposed three times (FLASH SIDE 2), the resulting images being developed on belt 20 at developing station 28 and transferred to the opposite or second side of the previously processed copy sheets which are now advanced (FEED SIDE 2) in timed relationship with auxiliary tray 102. Following transfer, the side two images are fused by fuser 150 and routed, by gate 184 toward stop 190, the latter being raised for this purpose. Abutment of the leading edge of the copy sheet with stop 190 causes the sheet trailing edge to be guided into discharge chute 186, effectively inverting the sheet, now bearing images on both sides. The inverted sheet is fed onto transport 181 and into an output receptacle such as sorter 14 where, in this example, the sheets are placed in successive ones of the first three trays 212 of either of the upper of lower arrays 210, 211 respectively depending on the disposition of deflector 220.

Further details of the Processor, including Sorter, the Controller and Machine Operation, including appropriate Tables are incorporated herein by reference to U.S. Pat. No. 4,122,996 assigned to the same assignee as the present invention.

DIAGNOSTICS

The reproduction machine of the present invention includes several diagnostic programs stored in ROM memory 545 to aid the user or service personnel to maintain the reliability of the machine. Some of the programs are more complex than others, with the most complex programs bearing significant meaning only to trained service personnel. Accordingly, the machine is programmed or conditioned to prohibit the casual user from accessing the most complex routines. However, some of the programs of lesser complexity can be useful to the trained user depending upon the extent of her familiarity with the machine. Accordingly, the machine of the present invention has the capability of permitting the service personnel to progressively disclose more complex diagnostic programs to the user as her training correspondingly increases, while at the same time reserving the most complex programs for use only by the service personnel.

Figure 20:
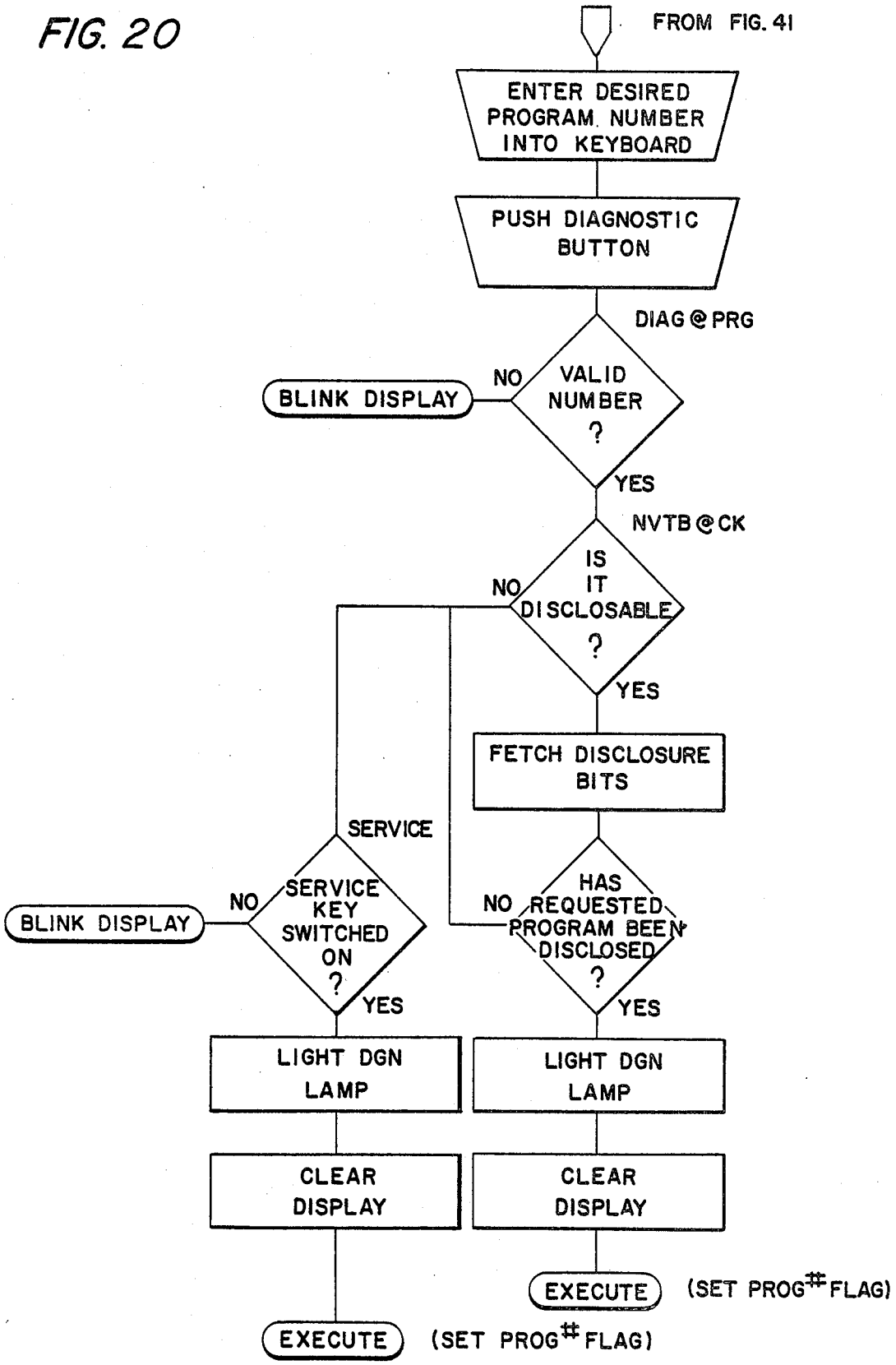

Referring now to FIGS. 19 and 20, along with the illustration of the operator console as shown in FIG. 18, the operating routine for selecting a desired diagnostic program will be explained. The machine is normally under the control of the Background or State Checker (STCK) routine. This routine periodically calls a Switch Scan routine (SWS@SCAN) reproduced in Table I. To enter a diagnostic program, the operator presses diagnostic console button 801 which is read by the Switch Scan routine thereby causing it to call a Diagnostic Program Entry routine (LVDGNPRG of Table II). This routine checks to see if there is an active diagnostic program in progress. If so, it causes the operating program to cease. Normally, there will not be another diagnostic program running. Consequently, a service flag (SER@ACT) will be set indicating that the user desires to enter a diagnostic program.

The State Checker routine is periodically calling the Tech Rep Change (TREP:CHG) subroutine which monitors the computer memory to determine whether the service flag has been set. If it has been set and there is no diagnostic routine information being displayed, the State Checker routine will change to the Tech Rep state. This routine, in turn, will periodically call the Diagnostic Prologue (DGN@PRL) routine also shown in Table II which puts a "dC" in the console display 230 thereby requesting that the operator enter the two digit code corresponding to the diagnostic program desired. After doing so, the diagnostics button 801 is then again pushed which, in turn, is picked up by the diagnostic program routine (DIAG@PRG of Table III). This routine determines whether the numbers entered to the display 230 correspond to valid diagnostic program numbers. For example, if numbers 10–36 are valid diagnostic programs and a number 52 was pushed, it would not be a valid number, with this program indicating such an error by blinking the display 230.

If it is a valid number, a Nonvolatile Memory Table Check routine (NVTB@CK) shown in Table IV is called. This routine first checks to determine whether the requested program number is disclosable, i.e., whether this particular routine can be accessed by an operator other than the service personnel. For example, assume that program numbers 10–15 can be, but need not be, disclosed to the user, with the remaining programs being reserved for the service personnel. Then, if the requested program number is within the 10–15 range this routine will check particular addresses in the nonvolatile memory 610 to determine whether the service personnel has stored this number in the memory, i.e. disclosed the program to the user. If it has been disclosed, the display 230 is cleared and the light on the console above the diagnostic button 801 is turned on indicating that the machine is now under the control of the diagnostic program desired.

On the other hand, if it was determined that the requested program was not disclosable to the user, the controller makes another check to determine whether the service key 828 has been switched on or off via the SWITCH SCAN routine and, periodically called subroutines SERVICE and KEY@OFF of Table II. Normally, only the service personnel possesses this key. When the key is turned on, all of the diagnostic program routines are accessible. However, if the requested program number has not been disclosed to the user nor has the service key been switched on, the display 230 will be caused to blink thereby indicating the error. Conversely, if the program is accessible, the program number flag is set signalling the controller to execute the requested program.

Figure 21:
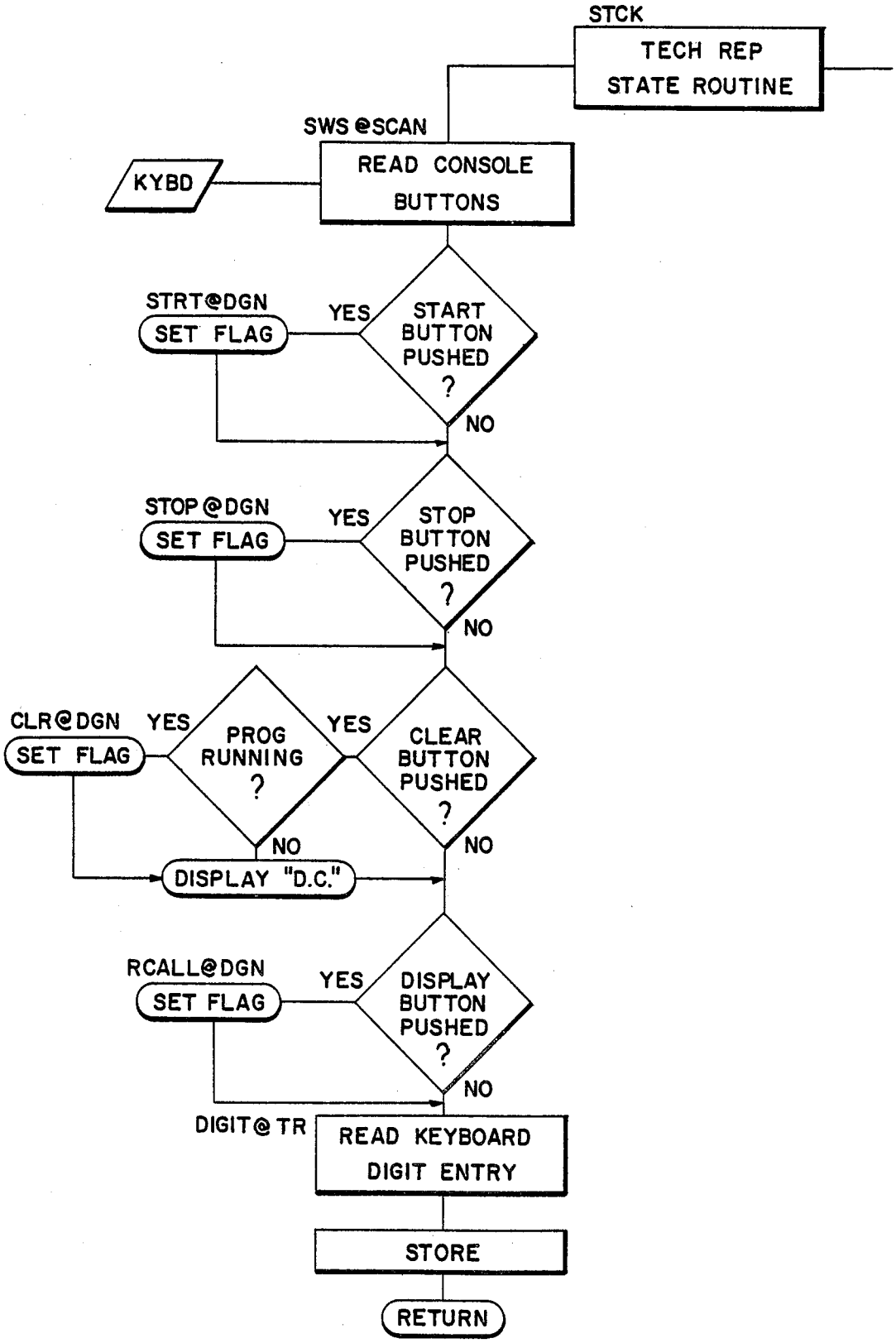
Figure 22:
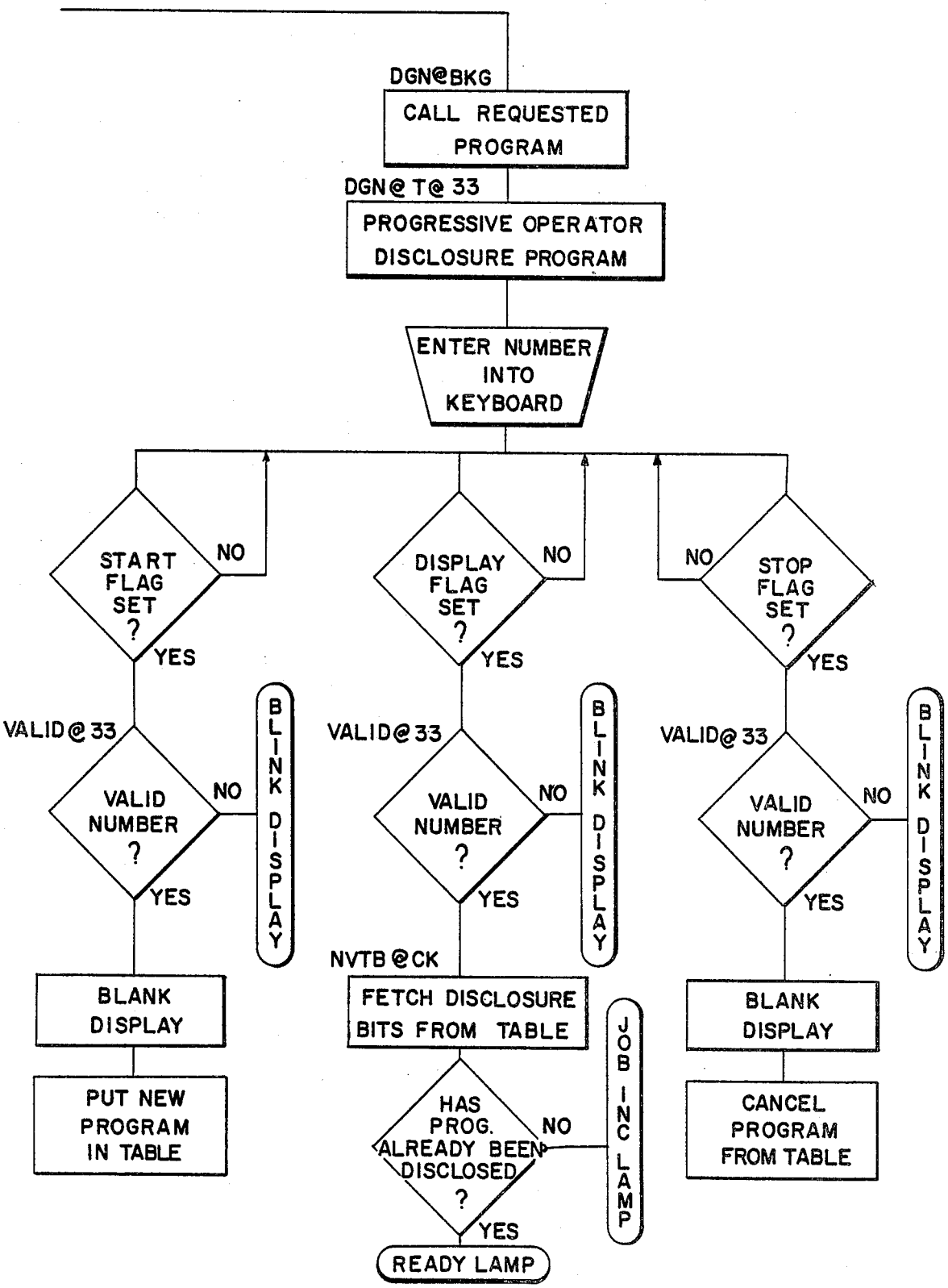

Referring to FIGS. 21 and 22, in order to disclose more complex programs to the user as he becomes more familiar with the machine, the service personnel utilizes the Progressive Operator Disclosure Program (DGN@T@33) shown in Table V. This program is not disclosable to the user and can be accessed only by the service personnel through the use of his service key. With the switch 828 turned on, the program is entered in the manner set forth above. To determine whether a particular program has already been disclosed, he enters the program number into keyboard 808 and pushes the Display button 809. The Switch Scan routine (SWS@SCAN) reads the various console buttons to determine whether they have been pushed, and, in this case, sets a flag, RCALL@DGN, indicating that the Display button 809 has been pushed. Similarly, another routine (DIGIT@TR of Table VI) reads the numbers entered in the keyboard 808 and stores them in a register or memory location for further use.

The Disclosure program (DGN@T@33) cause the controller to read the Display flag and calls a subroutine (VALID@33) which, in turn, checks the entered number to determine whether it is within a predetermined range. If it is not a valid number, the display 230 will blink indicating that the number does not correspond to a designated program number. If this test is passed, the controller 500 fetches the disclosure bits in a table in the non-volatile memory 610, via routine NTB@CK, such bits having been previously placed in dedicated locations therein by the service personnel.

As described above, this routine interrogates the memory to determine whether a bit or coded signal for the requested routine has been stored in the memory thereby indicating that it has already been disclosed. If it has been disclosed, one of the console lamps 830 (READY) will be turned on. If it has not been disclosed, another lamp (JOB INCOMPLETE) is lit. Accordingly, the service personnel can determine whether a particular program has already been disclosed to the user.

If he wishes to disclose a new program, he merely enters the number into keyboard 808 and presses Start button 805. If it is a valid number, it will be stored in memory 610 so that the user can now access the disclosed program. Conversely, if he wishes to cancel a program already disclosed, the stop button 806 is pushed instead. This removes the entered program number from memory 610 so that only the service personnel can access the diagnostic program. By storing the disclosed program access code in the non-volatile memory 610, it is insured that the code will not be lost in the event of a power failure etc.

Figure 23:
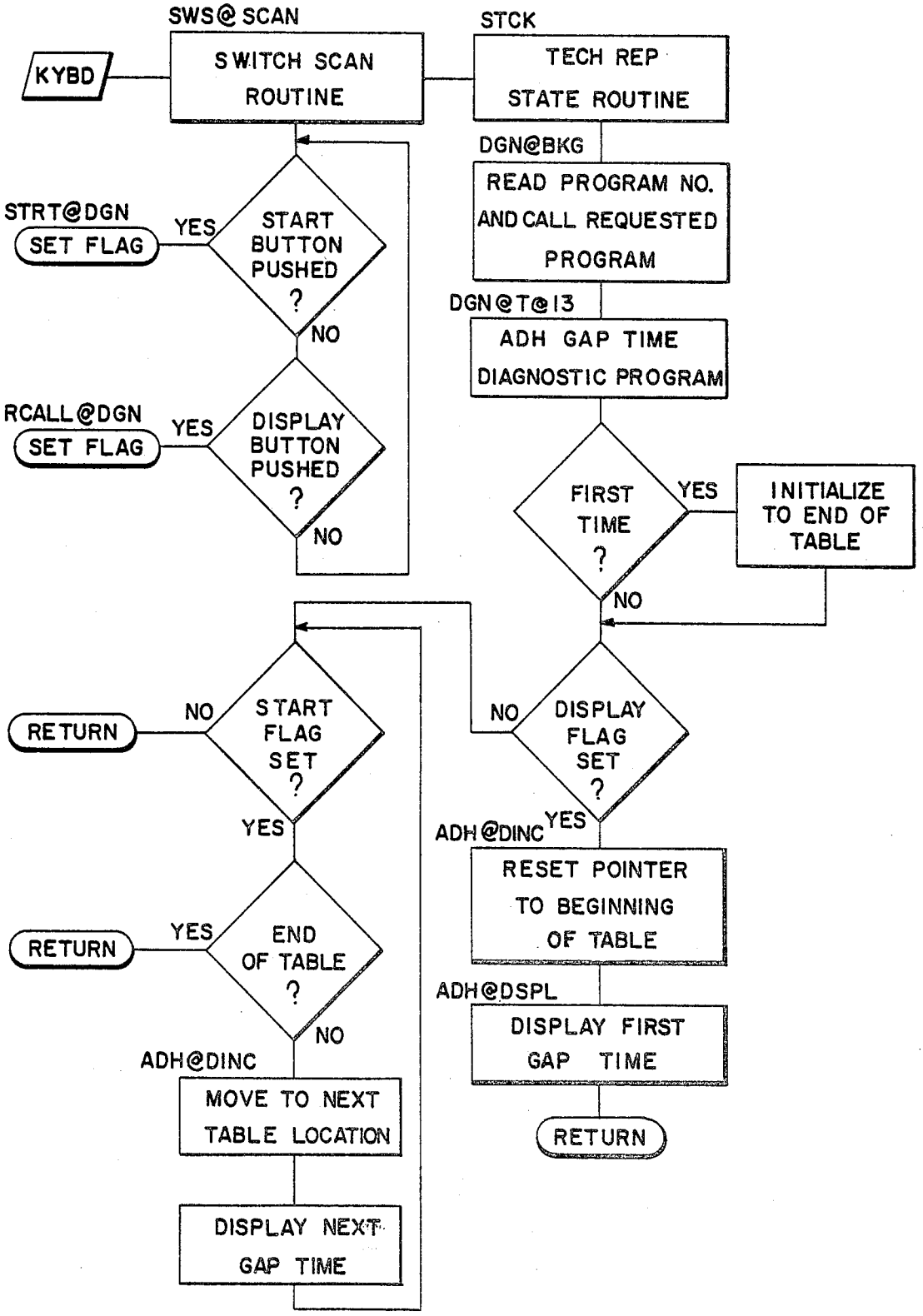
FIG. 23 is a flow chart which illustrates the operation of a diagnostic program for displaying document travel times in the document handler.

Referring now to FIGS. 23 and 14, a diagnostic program for the automatic document handler (ADH) 16 will be described. Document handler 16 includes four paper path sensors hereinafter referred to as the kick sensor 246, the wait sensor 280, the exit sensor 281, and the return sensor 282. As the original documents 2 cycle through the ADH as previously described, each sensor senses the leading and trailing edge of the document. For example, if the photocell sensor goes from light to dark, then it is sensing a leading edge. However, if the sensor goes from dark to light it is sensing a trailing edge. Each of the sensors are coupled to a free running global counter or timer, referred to as a diagnostic counter, DIAG@CT, in the tables. The diagnostic counter can be any of a variety of known counting devices. In the preferred embodiment, it is a specified register which is periodically set and then decremented by the machine clock signal 202.

When each sensor senses a leading or trailing edge of the document 2, the controller reads the time of the diagnostic counter and stores it in a specified addresses in the RAM memory 546. These times are accessed by the ADH Gap Time Diagnostic program (DGN@T@13) shown in Table VII. This routine reads the addresses of the stored times from the Gap Time Table shown in Table VIII. The Gap Time Table defines a plurality of stations or gap times, i.e. the time it takes for a document to travel between various preselected sensors. For example, one gap time may be the time it takes the leading edge of the document to travel from the exit sensor 281 to the return sensor 282. In such case, when the exit sensor 281 senses a leading edge of a document, it will read the diagnostic counter and store that time in the table (see, e.g. Lead Edge Exit routine (LEDGEXIT) of Table XIII. Similarly, when the return sensor 282 senses the document, it also will store that time in the table. Consequently, to read that gap time, a pointer, e.g. an index register, is set to the particular address of the Gap Time Table which, in turn, contains the addresses in RAM memory 546 of these two times. One time is then subtracted from the other to determine the particular gap time, i.e. the time of document travel between these sensors. It should be realized that a particular "gaps" defined in the Gap Time Table can be changed if desired.

Referring now especially to FIG. 23, the ADH Gap Time Diagnostic (DGN@T@13) program is entered in the usual manner as previously described to determine if this program has been disclosed to the user. If so, the program checks to determine whether this is the first time that this particular program has been requested. If it is the first time, the pointer is initialized by setting it to the end of the Gap Time Table. The routine then checks to see if the display flag (RCALL@DGN) has been set by the operator pushing the display select button 809 on console 800. If this button has been pushed, the switch scan routine will set a flag (RCALL@DGN) which is tested by the Diagnostic routine. If it has been set, the pointer will be decremented by the ADH Display Decrementing routine (ADH@DINC) shown in Table IX. This will cause display 230 to blank for approximately one-half second in order to permit the viewer to distinguish between the gap time about to be displayed and an old gap time that may be currently displayed. Then the gap time identified by the pointer (or identifier as sometimes referred to in the tables) is calculated and displayed in the display 230 via the ADH display routine (ADH@DSPL) which is also shown in Table IX. Accordingly, the first gap time of the previous document run will appear in the display. The operator or service personnel can compare this gap time with standard times and make necessary adjustments to the machine, if required, thereby insuring proper synchronism with the machine processor.

In order to display the next gap time the operator pushes start button 805. This sets the start flag (STRT@DGN) which is picked up by the Diagnostic program. It will check if the pointer is set at the end of the table. If not, the pointer is moved to the next table location and the next gap time is calculated and displayed in the display 230 as previously described. In order to display the next gap time the start button 805 is again pushed and the next gap time is analogously displayed. This operation occurs until the pointer reaches the end of the table.

Figure 25:
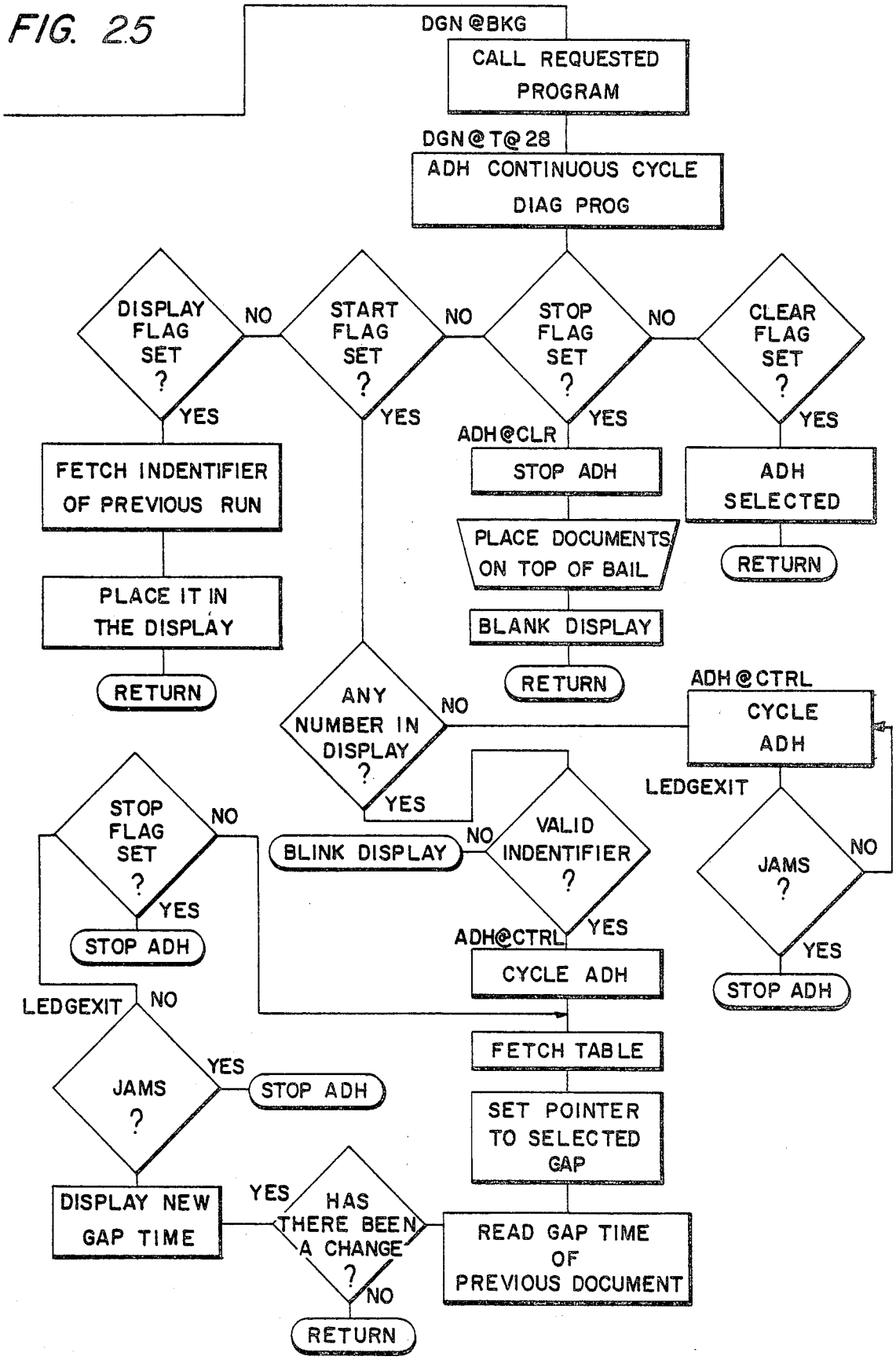
Figure 26:
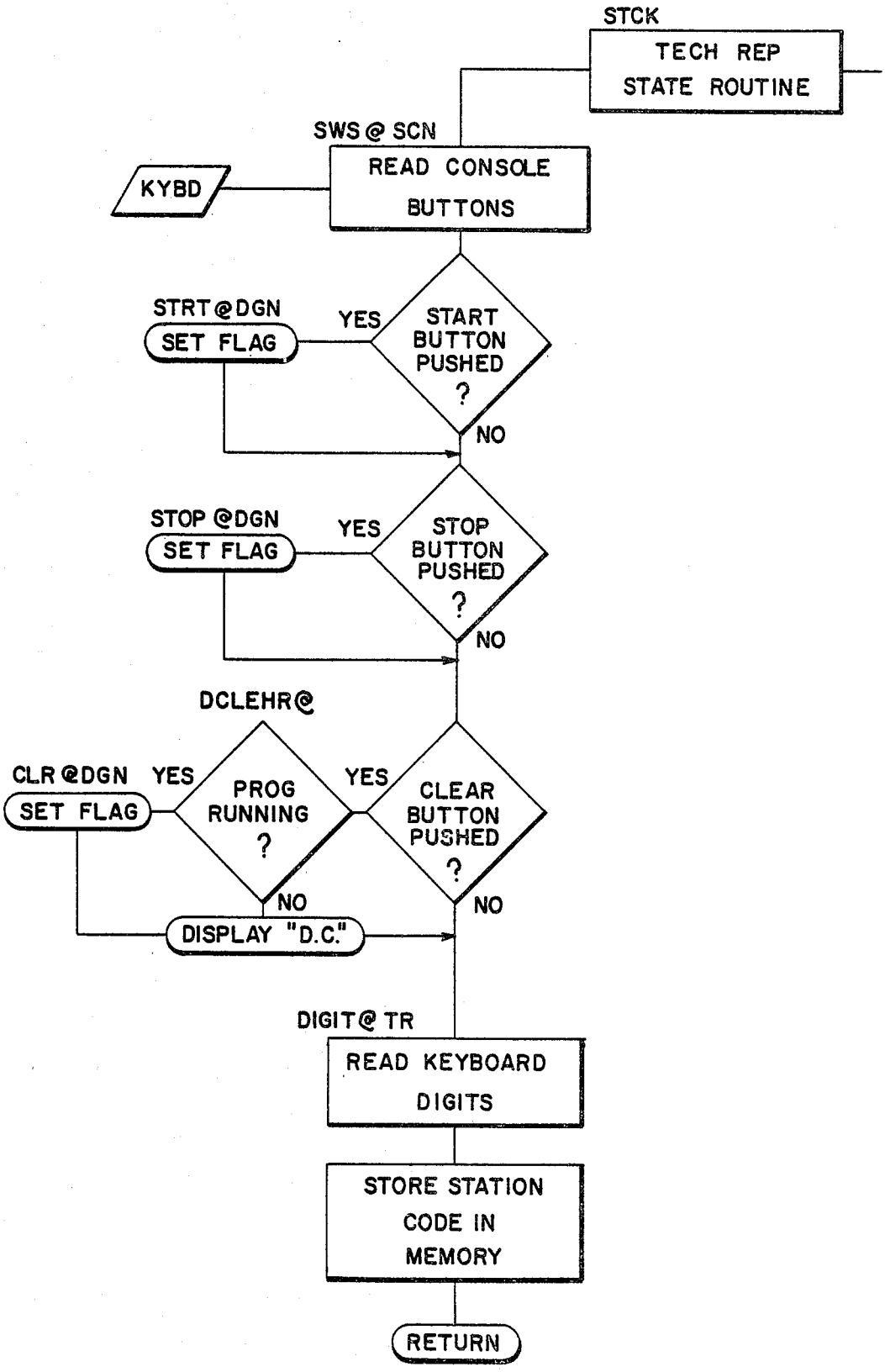
FIGS. 26 and 27 are flow charts which illustrate the operation of a diagnostic program which automatically moves documents to preselected stations in the document handler to check for proper alignment.

The previous routine provides the ability to check the gap times of an earlier run during normal ADH operation. However, in some instances it is desirable to activate or cycle the ADH without making copies in order to check for potential problem area. The ADH Continuous Cycle Diagnostic program (DVN@T@28 as shown in Table X) provides this ability. It should be noted that due to the complexity of this routine it is not disclosable to the casual operator and can be accessed only by the service personnel by switching the key switch 828 on. As illustrated in FIGS. 23 and 25, this routine interacts not only with the start button 805 and display select button 809 as in the previous routine, but also with the clear button 817, stop button 806 and keyboard 808. Pushing each of these buttons will set a specific flag as previously discussed.

By pushing the stop button 805, the ADH will come to a stop and display 230 will blank. At this time the operator should place the test documents on top of separator or bail bar 235 as shown in FIG. 4. After this is done, the clear button 817 is pushed thereby selecting and preparing the document handler 16 for continuously cycling original documents through the ADH paper paths.

The operator then decides whether he wishes to display gap times as the documents cycle through the ADH. If so, he enters the desired gap time code number into the keyboard 808. If he wishes to display the same gap time as previously requested, for example, as requested in the ADH Gap Time program (DGN@T@13) previously described, then the display button 809 is pushed which automatically places that gap time number into the display 230. The start button 805 is then pushed. If there is no number in the display the ADH begins to continuously cycle the documents 2 through the paper path under the control of the ADH Control routine (ADH@CTRL) shown in Table XII. If any jam occurs, as sensed by the sensors 246, 280, 281, and 282 (see, e.g. the Lead Edge Exit routine of Table XIII) the ADH will be automatically stopped thereby by permitting the user to identify the potential problem areas.

If a number has been entered into the display indicating that it is desired to display selected gap times, the program checks to see if the entered digits correspond to a valid gap time identifier. It will be remembered that there are several gap times in the Gap Time Table which can be displayed. If it is valid identifier, the ADH begins to cycle. The gap time table is then fetched and the pointer is set to the selected gap time desired to be displayed. It will be remembered that the table will contain the times of the previous document run, as these times are being continually updated every time a document travels through the ADH. Therefore, the program will read the gap time of the previous document and compare it with the new gap time of each document as it cycles through the ADH. It will then compare the two gap times to determine if there has been a change. If so, it will display the new gap time. This sequence of events continues until the stop button 806 is pushed. Hence, this routine provides the ability to continually display the gap times for each document as it travels through the document handler 16. By visually monitoring the display 230 the service personnel can readily determine whether there is an undesirable fluctuation in the gap times for the various documents. To display and monitor a different gap time, a new number is entered into keyboard 808 and the same sequence as described above is followed.

Document misalignment is often a potential source of problems in the document handler 16, often leading to a jam condition. The ADH skew Test program (DGN@T@29) as shown in Table XI is utilized to check for proper document alignment. Again this routine is entered in the manner as previously described and in this embodiment, access to this program is reversed to the service personnel.

Figure 27:
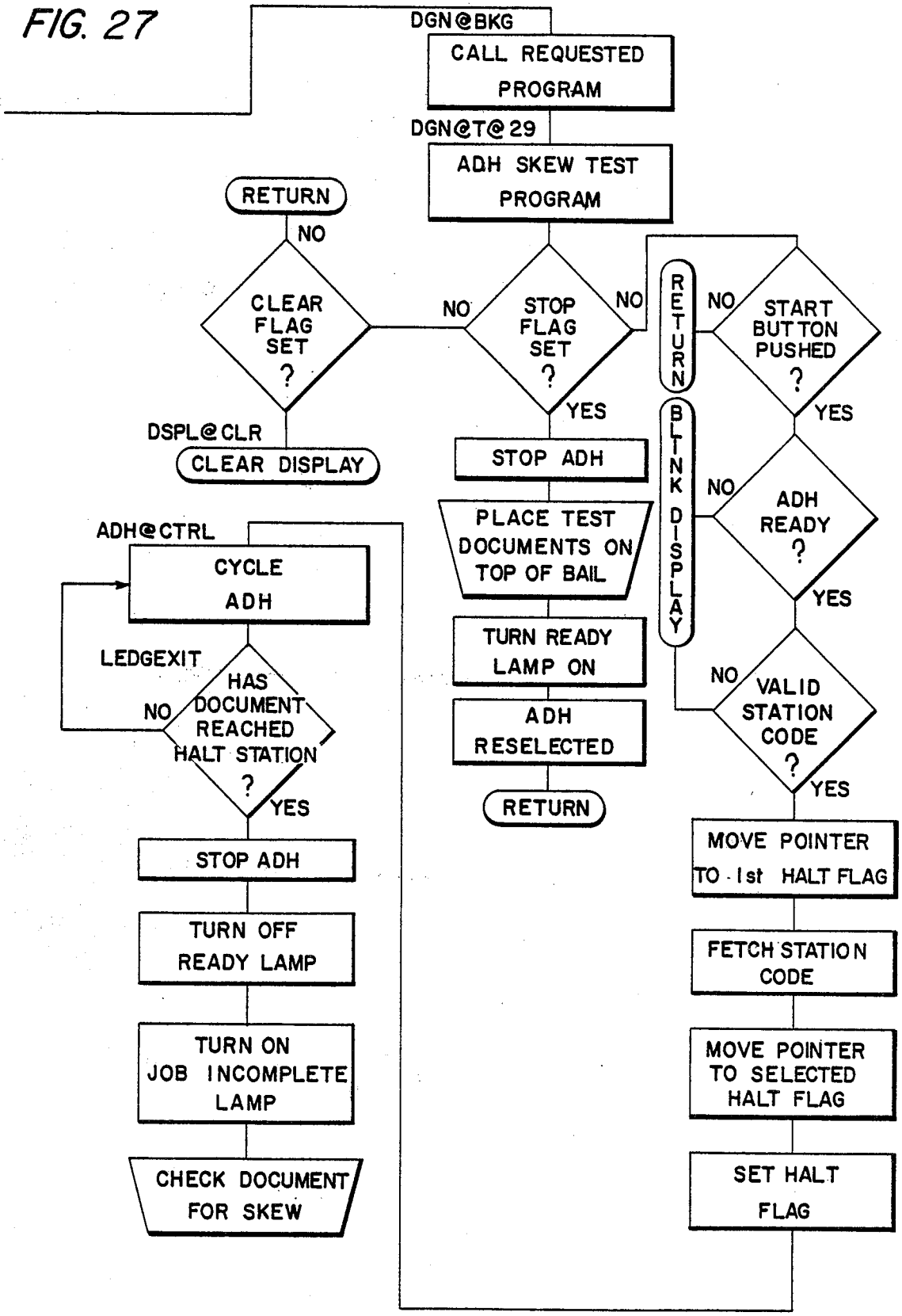

Referring to FIGS. 25 and 27, by pushing the stop button 806, document handler 16 will come to a halt permitting the operator to clear the documents form the ADH 16 and place the test documents on top of bail bar 235. When the appropriate covers (not shown) are closed, an appropriate console light 830 will be activated to indicate that the ADH has been reselected and is ready for further operation.

The operator then enters a one digit station code into the keyboard 808. The station code corresponds to selected stations in document handler 16. For example, station code number 1 corresponds to the station in the document handler with the leading edge of the document 2 underneath exit sensor 281 on its forward path towards platen 35. Other station codes for other stations are defined in a similar manner. In the preferred embodiment there are 5 valid station codes. As previously described, the digit read routine (DIGIT@TR) will read the enter digit and store it in a specified memory location. When the start button 805 is pushed, the controller will read that memory location and determine whether that is a valid station code, i.e. in this embodiment whether the digit entered is between the numbers 1 and 5. If so, the controller checks to make sure that there are no jams pending in the document handler 16 and that it is ready to be cycled again. If neither of the above tests are met, the display 230 is blinked to indicate the error. If the tests are met, a software pointer such as described previously, is moved to the address of the first of 5 halt flags which are stored in RAM memory 546. The halt flags correspond to sensors 246, 280, 281 and 282. The controller combines the address of the first halt flag with the station code entered to move the pointer to the halt flag corresponding to the selected station. The corret halt flag is then set.

After the appropriate halt flag has been set, the document handler 16 is they cycled, moving the test documents 2 from paper tray 233 throughout the paper path cycle under the control of the ADH control routine (ADH@CTRL) of Table XII. When the arrival of the document 2 is detected by sensors 246, 280, 281, 282, the controller checks to see if its corresponding halt flag is set. If so, the ADH is stopped. For example, when a document passes underneath sensor 281 on its forward path to platen 35, the Lead Edge Exit routine (TABLE XIII) checks to see if its corresponding halt flag (ADH@29@1) is set. If so, the ADH is stopped.

After the document handler 16 has been stopped with the document 2 at the selected station, appropriate indicator lamps 830 on the console 800 are turned on to indicate that the operator may now check for document alignment. By entering new codes into the keyboard 808 the ADH can be recycled to bring the document to another station for inspection. Accordingly, this routine provides the service personnel with the ability to visually check the documents for skew at various locations throughout the document handler 16 thereby insuring proper operation.

Therefore, while this invention has been described in connection with particular examples thereof, no limitation is intended thereby except as defined in the appended claims.

What is claimed is:

1. A method of controlling a reproduction machine to identify proper alignment of a sheet along its path, the reproduction machine having a memory, said method comprising:

defining a plurality of stations by disposing sensors along the path of the sheet;

entering into the memory a coded signal corresponding to one of the stations;

reading said memory when a sheet travels along the path; and stopping sheet travel at the selected station corresponding to the coded signal read from the memory.

2. The method of claim 1 which further comprises the steps of dedicating specified locations in the memory for coded signals corresponding to specified stations, each station having its own memory location; and entering the signal for the desired station by activating selected inputs on an operator console, thereby placing the signal in the specified memory location corresponding to the selected station at which it is desired for the sheet to be stopped along the sheet path.

3. The method of claim 1 wherein the step of entering into memory includes the step of entering a coded signal into the keyboard of an operator console thereby setting a flag in a specified memory location.

4. The method of claim 1 wherein more than one coded signal corresponds to the same sensor and where at least one station is remotely located from the sensors.

5. The method of claim 4 including the step of checking the sheet for proper alignment at the selected station.

6. A method of operating a reproduction machine for making copies from original documents, said machine including document handler means for transporting said documents between an input tray and an exposure platen along a document path with the actuation of machine components for making copies being under the control of a programmable controller being instructed by a master program, said method comprising:

storing at least one program in a first memory section for controlling the machine components for diagnostic purposes;

accessing said one program so that the controller is no longer instructed by said master program;

defining a plurality of stations along the document path in the document handler, the document path including sensors for detecting the presence of a document as it travels along the path;

dedicating specified locations in a second memory section for flags, with each flag corresponding to one of the stations;

entering a station code into the keyboard of an operator console thereby setting a flag corresponding to the selected station;

moving the documents through the document path of the document handler;

reading the corresponding memory location for each station as the document moves through the document path; and stopping the document at the selected station corresponding to said flag.

7. The method of claim 6 which further includes the step of:

activating an error display on the console if the entered station code number is not valid.

8. The method of claim 6 including the step of checking the document for proper alignment at the selected station.

* * * * *